US011867445B2

(12) United States Patent
Shi et al.

(10) Patent No.: US 11,867,445 B2
(45) Date of Patent: Jan. 9, 2024

(54) ICE MAKER AND CONTROL

(71) Applicant: Electrolux Home Products, Inc., Charlotte, NC (US)

(72) Inventors: Zhuochen Shi, Clemson, SC (US); Raony Barrios, Anderson, SC (US)

(73) Assignee: Electrolux Home Products, Inc., Charlotte, NC (US)

( * ) Notice: Subject to any disclaimer, the term of this patent is extended or adjusted under 35 U.S.C. 154(b) by 263 days.

(21) Appl. No.: 17/156,995

(22) Filed: Jan. 25, 2021

(65) Prior Publication Data

US 2022/0235991 A1 Jul. 28, 2022

(51) Int. Cl.
*F25C 5/08* (2006.01)
*F25C 1/04* (2018.01)

(52) U.S. Cl.
CPC ..... *F25C 5/08* (2013.01); *F25C 1/04* (2013.01); *F25C 2400/10* (2013.01); *F25C 2500/00* (2013.01); *F25C 2600/00* (2013.01); *F25C 2700/06* (2013.01); *F25C 2700/12* (2013.01)

(58) Field of Classification Search
CPC ..... F25C 5/08; F25C 1/04; F25C 2400/10; F25C 2500/00; F25C 2600/00; F25C 2700/06; F25C 2700/12; F25C 2305/024; F25C 2600/04
USPC ..... 62/73
See application file for complete search history.

(56) References Cited

U.S. PATENT DOCUMENTS 2,717,504 A * 9/1955 Knerr ..... F25C 5/187 62/157
3,276,225 A * 10/1966 Linstromberg ..... F25C 1/04 62/353
3,788,089 A * 1/1974 Graves ..... F25C 1/04 62/340
4,341,087 A * 7/1982 Van Steenburgh, Jr. ..... F25C 1/12 62/352

(Continued)

FOREIGN PATENT DOCUMENTS

EP 2620726 7/2013
EP 2620726 B1 * 9/2019 ..... F25C 1/00

(Continued)

OTHER PUBLICATIONS

KR 20090053342 A—machine translation (Year: 2023).*

(Continued)

*Primary Examiner* — Eric S Ruppert
*Assistant Examiner* — Kirstin U Oswald
(74) *Attorney, Agent, or Firm* — Pearne & Gordon LLP

(57) ABSTRACT

In a method for controlling an ice maker, a motor rotates an ejector finger relative to an ice tray in a first direction and in a second direction opposite the first direction to discharge ice from the ice tray. When an error condition occurs, the ice maker enters a first error mode, during which an ice maker heater is turned on until the temperature of the ice tray reaches a predetermined temperature or until an ice maker heater error correction time elapses. When the ejector finger is at a home position, the motor rotates in the second direction until the ejector finger is not at the home position or for a first predetermined number of steps, whichever occurs first, and then rotates in the first direction until the ejector finger is at the home position.

9 Claims, 18 Drawing Sheets

(56) References Cited

U.S. PATENT DOCUMENTS

| | | | | | |
|---|---|---|---|---|---|
| 4,741,169 | A * | 5/1988 | Linstromberg | F25C 5/08 | 62/135 |
| 4,833,894 | A * | 5/1989 | Chesnut | F25C 1/04 | 62/135 |
| 4,872,318 | A * | 10/1989 | Klemmensen | F25C 1/04 | 62/344 |
| 5,010,738 | A * | 4/1991 | Brown | F25C 1/04 | 62/135 |
| 5,182,916 | A * | 2/1993 | Oike | F25C 1/20 | 62/353 |
| 6,574,974 | B1 | 6/2003 | Herzog et al. | | |
| 6,637,217 | B2 | 10/2003 | Kim et al. | | |
| 6,679,073 | B1 | 1/2004 | Hu | | |
| 6,857,279 | B2 | 2/2005 | Kim et al. | | |
| 6,895,767 | B2 | 5/2005 | Hu | | |
| 7,080,518 | B2 | 7/2006 | Kim et al. | | |
| 2001/0025492 | A1* | 10/2001 | Niwa | F25C 5/187 | 62/1 |
| 2005/0072166 | A1* | 4/2005 | Lee | F25C 1/04 | 62/353 |
| 2006/0016205 | A1* | 1/2006 | Tremblay | F25C 1/04 | 62/340 |
| 2006/0016207 | A1* | 1/2006 | Tremblay | F25C 1/04 | 62/353 |
| 2006/0086107 | A1* | 4/2006 | Voglewede | F25C 1/246 | 62/157 |
| 2006/0201170 | A1* | 9/2006 | Cole | F25C 1/04 | 62/340 |
| 2006/0242971 | A1* | 11/2006 | Cole | F25C 5/08 | 62/340 |
| 2007/0039335 | A1* | 2/2007 | Kwon | F25C 5/187 | 62/138 |
| 2010/0018226 | A1* | 1/2010 | Kim | F25C 1/18 | 62/73 |
| 2013/0174587 | A1 | 7/2013 | Lee | | |
| 2019/0063811 | A1 | 2/2019 | Tanimura | | |
| 2019/0086134 | A1 | 3/2019 | Lee et al. | | |

FOREIGN PATENT DOCUMENTS

| | | | | |
|---|---|---|---|---|
| KR | 20090053342 | | 5/2009 | |
| KR | 20090053342 | A * | 5/2009 | |
| KR | 20130025784 | | 3/2013 | |
| KR | 20150132969 | | 11/2015 | |
| KR | 20150145705 | A * | 12/2015 | |
| WO | WO-2008130115 | A1 * | 10/2008 | F25C 5/08 |

OTHER PUBLICATIONS

KR 1020090053342 A—Human translation (Year: 2023).*

International Search Report for PCT/US2022/013127, dated Apr. 13, 2022. 3 pages.

* cited by examiner

ICE MAKER AND CONTROL

CROSS-REFERENCE TO RELATED APPLICATIONS

Not Applicable.

FIELD OF THE INVENTION

This application relates generally to a refrigeration appliance with an ice maker, and more particularly, to a control algorithm that controls various operations of an ice maker arranged in a fresh food compartment of a refrigerator.

BACKGROUND OF THE INVENTION

Refrigeration appliances, such as domestic refrigerators, typically have both a fresh food compartment and a freezer compartment or section. The fresh food compartment is where food items such as fruits, vegetables, and beverages are stored and the freezer compartment is where food items that are to be kept in a frozen condition are stored. The refrigerators are provided with a refrigeration system that maintains the fresh food compartment at temperatures above 0° C., such as between 0.25° C. and 4.5° C. and the freezer compartments at temperatures below 0° C., such as between 0° C. and −20° C.

The arrangements of the fresh food and freezer compartments with respect to one another in such refrigerators vary. For example, in some cases, the freezer compartment is located above the fresh food compartment and in other cases the freezer compartment is located below the fresh food compartment. Additionally, many refrigerators have their freezer compartments and fresh food compartments arranged in a side-by-side relationship. Whatever arrangement of the freezer compartment and the fresh food compartment is employed, typically, separate access doors are provided for the compartments so that either compartment may be accessed without exposing the other compartment to the ambient air.

Refrigerators are often provided with a unit for making ice pieces, commonly referred to as "ice cubes" despite the non-cubical shape of many such ice pieces. These ice making units normally are located in the freezer compartments of the refrigerators and manufacture ice by convection, i.e., by circulating cold air over water in an ice tray to freeze the water into ice cubes. Storage bins (e.g., buckets) for storing the frozen ice pieces are often provided adjacent to the ice making units. The ice pieces can be dispensed from the storage bins through a dispensing port in the refrigerator door that closes the freezer to the ambient air. The dispensing of the ice usually occurs by means of an ice delivery mechanism that extends between the storage bin and the dispensing port in the freezer compartment door.

For refrigerators such as the so-called "bottom mount" refrigerator, which includes a freezer compartment disposed vertically beneath a fresh food compartment, the ice maker may be arranged within the freezer compartment or the fresh food compartment.

A typical ice-making cycle includes the steps of initialization, freeze, check bail arm, harvest ice cubes, and water fill. An ejector finger pivots relative to the ice tray for removing ice pieces from the ice tray during the ice harvesting process.

However, in certain situations, the ejector finger cannot rotate, possibly due to accumulation of ice that causes a blockage in the ice tray. It is desirable to provide a reliable ice maker control to detect and remove ice that may be interfering with the movement of the ejector finger.

BRIEF SUMMARY OF THE INVENTION

In accordance with one aspect, there is provided a method for controlling an ice maker having an ice maker heater and a motor that rotates an ejector finger relative to an ice tray in a first direction and in a second direction opposite the first direction to discharge ice from the ice tray. The method includes determining whether an error condition has occurred and, when it is determined that the error condition has occurred, entering a first error mode. The first error mode includes turning on the ice maker heater, turning off the ice maker heater when an ice maker heater error correction time has elapsed or when a temperature of the ice tray is equal to or greater than a first predetermined temperature, and determining whether the ejector finger is at a home position. When the ejector finger is at the home position, the first error mode further includes rotating the motor in the second direction until the ejector finger is not at the home position or for a first predetermined number of steps, whichever occurs first, and then rotating the motor in the first direction until the ejector finger is at the home position. When the ejector finger is not at the home position, the first error mode further includes rotating the motor in the second direction until the ejector finger is at the home position or for a second predetermined number of steps, whichever occurs first.

In the method according to the foregoing aspect, the determining whether the error condition has occurred includes determining the error condition has occurred when the ejector finger cannot rotate in one of the first direction or in the second direction.

In the method according to the foregoing aspect, the determining whether the ejector finger is at the home position is performed by a sensor configured to detect an angular position of the ejector finger.

In the method according to the foregoing aspect, the determining whether the error condition has occurred includes determining the error condition has occurred when the ejector finger is not at the home position at some time during the rotating the motor.

In the method according to the foregoing aspect, the method further includes exiting the first error mode when, after rotating the motor in the first direction or in the second direction, the ejector finger is at the home position within a first predetermined time; and entering a second error mode different from the first error mode if the first error mode is not exited after the first predetermined time.

In the method according to the foregoing aspect, the second error mode includes turning on the ice maker heater; turning off the ice maker heater when the temperature of the ice tray is equal to or greater than a second predetermined temperature; and determining whether the ejector finger is at the home position. When the ejector finger is not at the home position, the second error mode includes terminating the second error mode and entering the first error mode. When the ejector finger is at the home position, the second error mode includes rotating the motor in the first direction for a third predetermined number of steps. The second error mode further includes determining whether the ejector finger is at the home position. When the ejector finger is at the home position, the second error mode includes terminating the second error mode. When the ejector finger is not at the home position, the second error mode includes rotating the motor in the first direction until the ejector finger is at the home position and terminating the second error mode or, if the ejector finger is not at the home position after rotating the motor for the second predetermined number of steps, waiting for a second predetermined time and after the second predetermined time elapses, entering the first error mode.

In the method according to the foregoing aspect, the method further includes counting at least one of an ice maker heater deactivation period of time or a time the icemaker has been making ice; and comparing at least one of the ice maker heater deactivation period of time or the time the icemaker has been making ice to a third predetermined time. When at least one of the ice maker heater deactivation period of time or the time the icemaker has been making ice is equal to or greater than the third predetermined time and when an ice bin is not full of ice, the method further includes turning on the ice maker heater to melt frost built up on the ice tray; monitoring the temperature of the ice tray; comparing the temperature of the ice tray to a third predetermined temperature; and turning off the ice maker heater when the temperature of the ice tray is equal to or greater than the third predetermined temperature.

In the method according to the foregoing aspect, the method further includes, after turning off the ice maker heater, filling the ice maker with water.

In the method according to the foregoing aspect, the determining whether the error condition has occurred includes determining the error condition has occurred when the ejector finger rotates in the second direction the first predetermined number of steps and the ejector finger is not at the home position.

In the method according to the foregoing aspect, the determining whether the error condition has occurred includes determining the error condition has occurred when the ejector finger rotates in the second direction the second predetermined number of steps and the ejector finger is not at the home position.

In accordance with another aspect, there is provided a method for controlling an ice maker having an ice bin, a motor configured to rotate an ejector finger relative to an ice tray in a first direction and in a second direction opposite the first direction to discharge ice from the ice tray, and an ice maker heater. The method includes rotating the ejector finger to a home position; when the ejector finger is at the home position: turning on the ice maker heater; turning off the ice maker heater when an ice maker heater harvest time has elapsed or when a temperature of the ice tray is equal to or greater than a first predetermined temperature; and performing a harvest operation. The harvest operation includes: rotating the motor in the second direction until the ejector finger is not at the home position, then rotating the motor in the second direction until the ejector finger is at the home position, and then rotating the motor in the second direction until the ejector finger is not at the home position. When the harvest operation is completed before the motor has rotated a corresponding number of steps, the method further includes rotating the motor in the first direction until the ejector finger is at the home position and when any part of the harvest operation is not completed before the motor has rotated the corresponding number of steps, entering a first error mode; determining at least one of a time that the ice maker heater has been deactivated or a time the icemaker has been making ice; comparing at least one of the time that the ice maker heater has been deactivated or a time the icemaker has been making ice to a predetermined time; turning on the ice maker heater when at least one of the time that the ice maker heater has been deactivated or the time the icemaker has been making ice is equal to or greater than the predetermined time; and when at least one of the time that the ice maker heater has been deactivated or the time the icemaker has been making ice is lower than the predetermined time, filling the ice tray with water.

The method according to the foregoing aspect further comprises, after turning off the ice maker heater, filling the ice tray with water.

In accordance with another aspect, there is provided an ice maker including an ice tray having an ice mold with an upper surface and a plurality of cavities formed therein for freezing water into ice pieces; a heater attached to a bottom surface of the ice mold; a motor configured to rotate an ejector finger relative to the ice tray in a first direction and in a second direction opposite the first direction to discharge the ice pieces from the ice tray; an ice bin configured to receive and store the ice pieces from the ice tray; and a controller. The controller is programmed to determine whether an error condition has occurred. When it is determined that the error condition has occurred, the controller causes the ice maker to enter a first error mode. The first error mode comprises turning on the heater; turning off the heater when an ice maker heater error correction time has elapsed or when a temperature of the ice tray is equal to or greater than a first predetermined temperature; and determining whether the ejector finger is at a home position. When the ejector finger is at the home position, the first error mode further comprises rotating the motor in the second direction until the ejector finger is not at the home position or for a first predetermined number of steps, whichever occurs first, and then rotating the motor in the first direction until the ejector finger is at the home position. When the ejector finger is not at the home position, the first error mode further comprises rotating the motor in the second direction until the ejector finger is at the home position or for a second predetermined number of steps, whichever occurs first.

The ice maker according to the foregoing aspect further comprises a bail arm attached to the ice tray. The bail arm is configured to pivot between an ice sensing position for sensing a level of ice within the ice bin and an ice harvest position. When the ejector finger is at the home position and the bail arm is in the ice harvest position, the controller is further configured to rotate the motor and the ejector finger to harvest the ice pieces and transfer the ice pieces into the ice bin.

In the ice maker according to the foregoing aspect, the temperature of the ice tray is monitored by a temperature sensor arranged on the ice tray and operatively connected to the controller.

DESCRIPTION OF EXAMPLE EMBODIMENTS

Figure 1:
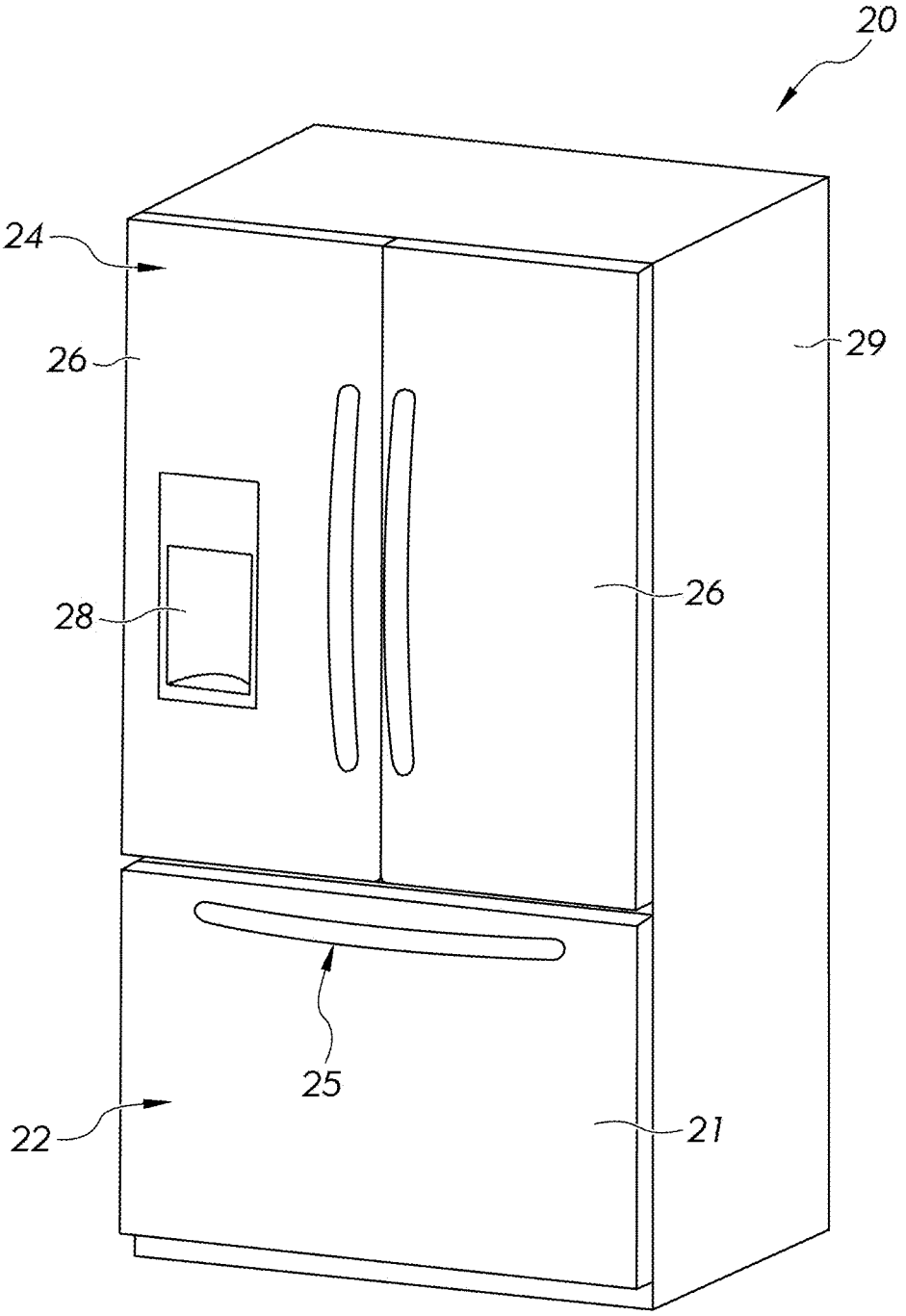
FIG. 1 is a front perspective view of a household French Door Bottom Mount showing doors of the refrigerator in a closed position.

An apparatus and a method will now be described more fully hereinafter with reference to the accompanying drawings in which embodiments of the disclosure are shown. Whenever possible, the same reference numerals are used throughout the drawings to refer to the same or like parts. However, this disclosure may be embodied in many different forms and should not be construed as limited to the embodiments set forth herein.

Figure 2:
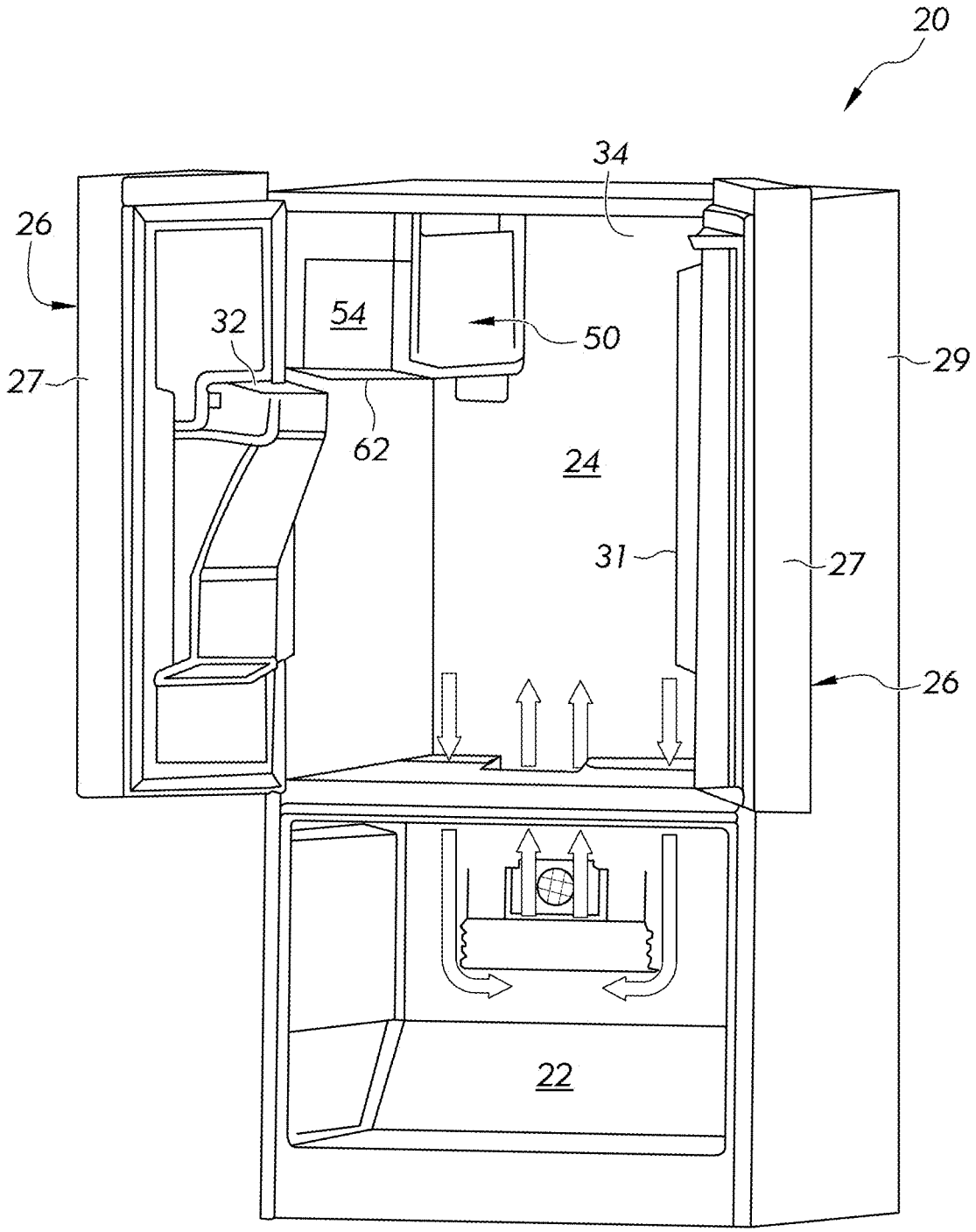
FIG. 2 is a front perspective view of the refrigerator of FIG. 1 showing the doors in an open position and an ice maker in a fresh food compartment.

Referring now to the drawings, FIG. 1 shows a refrigeration appliance in the form of a domestic refrigerator, indicated generally at 20. Although the detailed description that follows concerns a domestic refrigerator 20, the invention can be embodied by refrigeration appliances other than with a domestic refrigerator 20. Further, an embodiment is described in detail below, and shown in the figures as a bottom-mount configuration of a refrigerator 20, including a fresh food compartment 24 disposed vertically above a freezer compartment 22. However, the refrigerator 20 can have any desired configuration including at least a fresh food compartment 24 and an ice maker 50 (as shown in FIG. 2), such as a top mount refrigerator (freezer disposed above the fresh food compartment), a side-by-side refrigerator (fresh food compartment is laterally next to the freezer compartment), a standalone refrigerator or freezer, etc.

One or more doors 26 shown in FIG. 1 are pivotally coupled to a cabinet 29 of the refrigerator 20 to restrict and grant access to the fresh food compartment 24. The door 26 can include a single door that spans the entire lateral distance across the entrance to the fresh food compartment 24, or can include a pair of French-type doors 26 as shown in FIG. 1 that collectively span the entire lateral distance of the entrance to the fresh food compartment 24 to enclose the fresh food compartment 24. For the latter configuration, a center flip mullion 31 (FIG. 2) is pivotally coupled to at least one of the doors 26 to establish a surface against which a seal provided to the other one of the doors 26 can seal the entrance to the fresh food compartment 24 at a location between opposing side surfaces 27 (FIG. 2) of the doors 26. The mullion 31 can be pivotally coupled to the door 26 to pivot between a first orientation that is substantially parallel to a planar surface of the door 26 when the door 26 is closed, and a different orientation when the door 26 is opened. The externally-exposed surface of the center mullion 31 is substantially parallel to the door 26 when the center mullion 31 is in the first orientation, and forms an angle other than parallel relative to the door 26 when the center mullion 31 is in the second orientation. The seal and the externally-exposed surface of the mullion 31 cooperate approximately midway between the lateral sides of the fresh food compartment 24.

Turning back to FIG. 1, a dispenser 28 for dispensing at least ice pieces, and optionally water, can be provided on an exterior of one of the doors 26 that restricts access to the fresh food compartment 24. The dispenser 28 includes a lever, switch, proximity sensor or other device that a user can interact with to cause frozen ice pieces to be dispensed from an ice bin 54 (FIG. 2) of the ice maker 50 disposed within the fresh food compartment 24. Ice pieces from the ice bin 54 can exit the ice bin 54 through an aperture 62 and be delivered to the dispenser 28 via an ice chute 32 (FIG. 2), which extends at least partially through the door 26 between the dispenser 28 and the ice bin 54.

Referring to FIG. 1, the freezer compartment 22 is arranged vertically beneath the fresh food compartment 24. A drawer assembly (not shown) including one or more freezer baskets (not shown) can be withdrawn from the freezer compartment 22 to grant a user access to food items stored in the freezer compartment 22. The drawer assembly can be coupled to a freezer door 21 that includes a handle 25. When a user grasps the handle 25 and pulls the freezer door 21 open, at least one or more of the freezer baskets is caused to be at least partially withdrawn from the freezer compartment 22.

The freezer compartment 22 is used to freeze and/or maintain articles of food stored in the freezer compartment 22 in a frozen condition. For this purpose, the freezer compartment 22 is in thermal communication with a freezer evaporator (not shown) that removes thermal energy from the freezer compartment 22 to maintain the temperature therein at a temperature of 0° C. or less during operation of the refrigerator 20, preferably between 0° C. and −50° C., more preferably between 0° C. and −30° C. and even more preferably between 0° C. and −20° C.

Referring to FIG. 2, the refrigerator 20 includes an interior liner 34 that defines the fresh food compartment 24. The fresh food compartment 24 is located in the upper portion of the refrigerator 20 in this example and serves to minimize spoiling of articles of food stored therein. The fresh food compartment 24 accomplishes this by maintaining the temperature in the fresh food compartment 24 at a cool temperature that is typically above 0° C., so as not to freeze the articles of food in the fresh food compartment 24. It is contemplated that the cool temperature preferably is between 0° C. and 10° C., more preferably between 0° C. and 5° C. and even more preferably between 0.25° C. and 4.5° C. According to some embodiments, cool air from which thermal energy has been removed by the freezer evaporator 82 can also be blown into the fresh food compartment 24 to maintain the temperature therein greater than 0° C. preferably between 0° C. and 10° C., more preferably between 0° C. and 5° C. and even more preferably between 0.25° C. and 4.5° C. For alternate embodiments, a separate fresh food evaporator (not shown) can optionally be dedicated to separately maintaining the temperature within the fresh food compartment 24 independent of the freezer compartment 22. According to an embodiment, the temperature in the fresh food compartment 24 can be maintained at a cool temperature within a close tolerance of a range between 0° C. and 4.5° C., including any subranges and any individual temperatures falling with that range. For example, other embodiments can optionally maintain the cool temperature within the fresh food compartment 24 within a reasonably close tolerance of a temperature between 0.25° C. and 4° C.

The upper compartment and the lower compartment of the liner 72 are configured such that the air circulated in the upper compartment is maintained separated from the air circulated in the lower compartment. The lower compartment defines the freezer compartment 100 and an adjustable temperature drawer or a Variable Climate Zone ("VCZ") compartment 150. In this respect, the air circulated in the fresh food compartment 52 is maintained separated from the air circulated in the VCZ compartment 150 and the freezer compartment 100.

Figure 3:
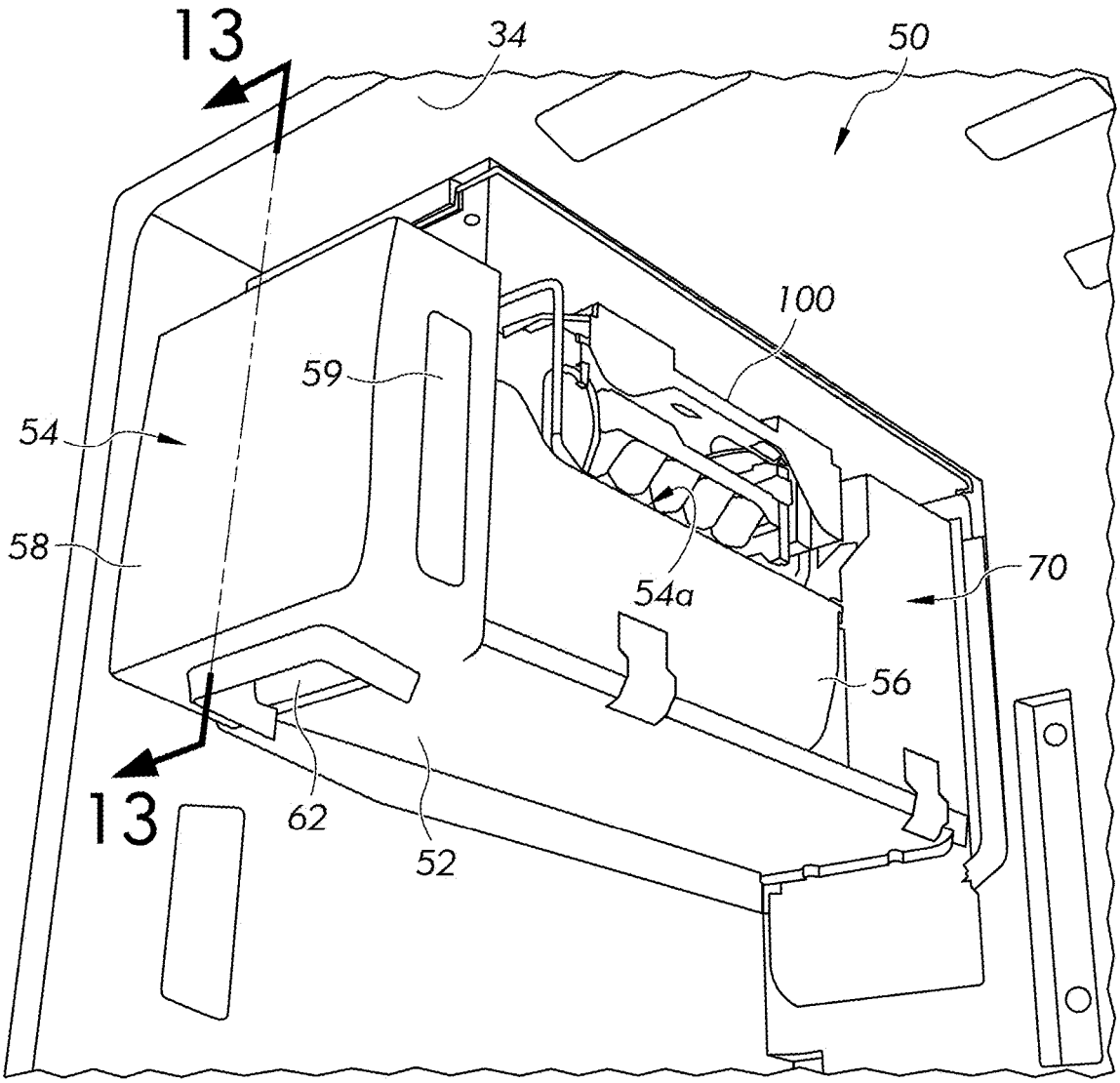
FIG. 3 is a side perspective view of an ice maker with a side wall of a frame of the ice maker removed for clarity.

An illustrative embodiment of the ice maker 50 is shown in FIG. 3. In general, the ice maker 50 includes a frame or enclosure 52, an ice bin 54, an air handler assembly 70 and an ice tray assembly 100. The ice bin 54 stores ice pieces made by the ice tray assembly 100 and the air handler assembly 70 circulates cooled air to the ice tray assembly 100 and the ice bin 54. The ice maker 50 is secured within the fresh food compartment 24 using any suitable fastener. The frame 52 is generally rectangular-in-shape for receiving the ice bin 54. The frame 52 includes insulated walls for thermally isolating the ice maker 50 from the fresh food compartment 24. A plurality of fasteners (not shown) may be used for securing the frame 52 of the ice maker 50 within the fresh food compartment 24 of the refrigerator 20. The ice tray assembly 100, in turn, can be secured to the frame 52.

For clarity, the ice maker 50 in FIG. 3 is shown with a side wall of the frame 52 removed; normally, the ice maker 50 would be enclosed by insulated walls. The ice bin 54 includes a housing 56 having an open, front end and an open top. A front cover 58 is secured to the front end of the housing 56 to enclose the front end of the housing 56. When secured together to form the ice bin 54, the housing 56 and the front cover 58 define an internal cavity 54*a* of the ice bin 54 used to store the ice pieces made by the ice tray assembly 100. In various other examples, a recess 59 may be formed in a side of the front cover 58 to define a handle that may be used by a user for ease in removing the ice bin 54 from the ice maker 50. An aperture 62 is formed in a bottom of the front cover 58. A rotatable auger (not shown) can extend along a length of the ice bin 54. As the auger rotates, ice pieces in the ice bin 54 are urged ice towards the aperture 62 wherein an ice crusher (not shown) may be disposed. The ice crusher may be provided for crushing the ice pieces conveyed thereto, when a user requests crushed ice. The auger can optionally be automatically activated and rotated by an auger motor assembly (not shown) of the air handler assembly 70. The aperture 62 can be aligned with the ice chute 32 (FIG. 2) when the door 26 is closed. This alignment allows for the auger to push the frozen ice pieces stored in the ice bin 54 into the ice chute 32 to be dispensed by the dispenser 28.

Figure 4:
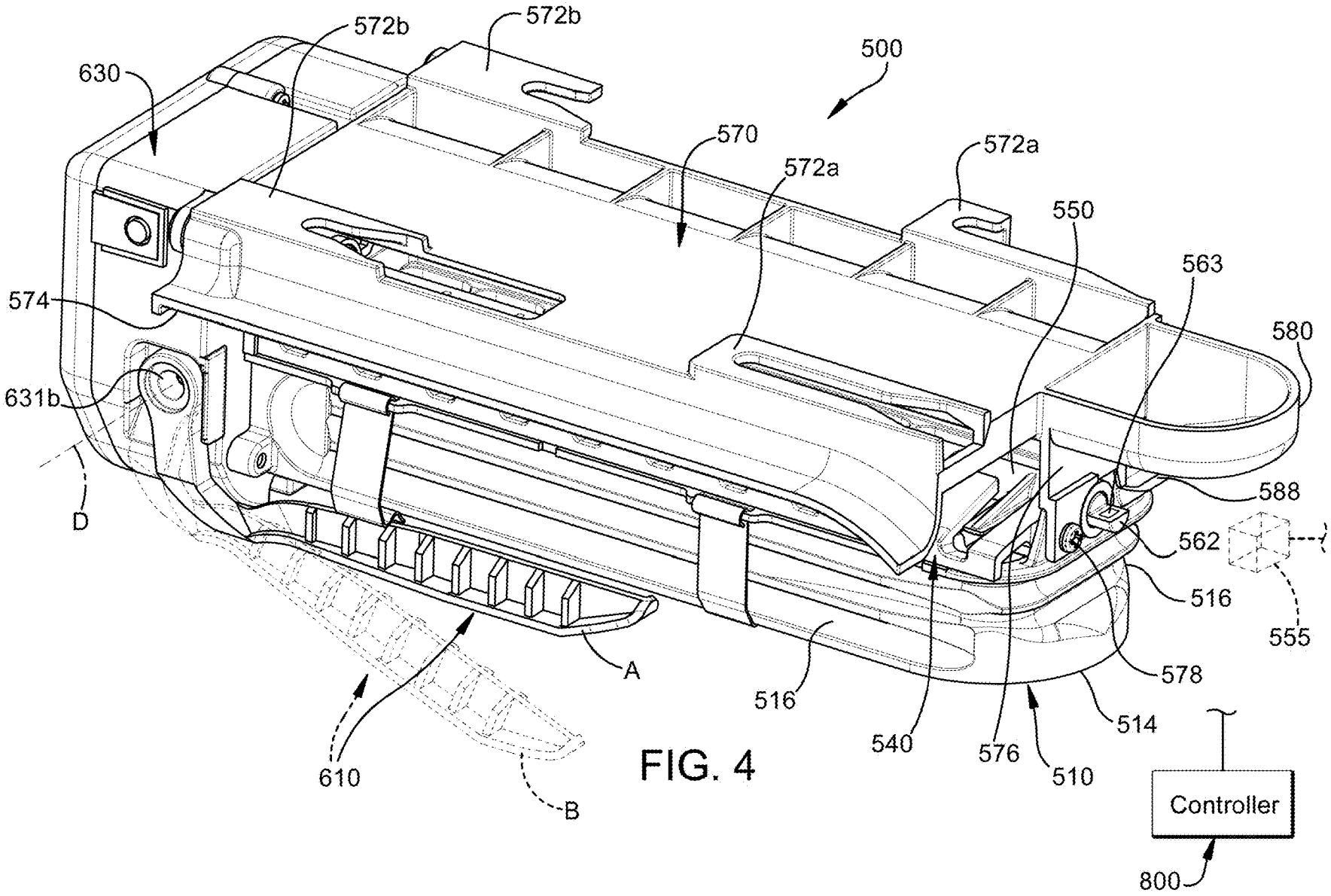
FIG. 4 is a side perspective view of an ice tray assembly for the ice maker of FIG. 3 illustrating a bail arm in both a first, upper position and a second, lower position.

Referring to FIG. 4, an ice tray assembly 500, in general, includes an ice mold 510, an ice stripper 540, an ice ejector 550, a cover 570, a bail arm 610, and a gear box 630. The gear box 630 includes a plurality of gears for moving various components of an ice maker, such as the ice ejector 550 and the bail arm 610, for example. The gear box 630 is usually attached to an end of the ice tray assembly 500. Components of the ice maker illustrated in FIGS. 4-15D are described in U.S. Pat. No. 10,539,354 and US publications 2020/0080759 and 2020/0109886, for example, the entire contents of which are incorporated herein by reference.

A temperature sensor 520 (FIG. 5), such as a negative temperature coefficient (NTC) thermistor, for example, may be positioned to measure the temperature of the ice tray 510. For example, the temperature sensor 520 can be positioned between ice mold 510 (i.e., the ice tray 510) and the gear box 630. Other locations or arrangements of the temperature sensor 520 may be suitable for detecting the temperature of the ice tray 510.

Figure 7:
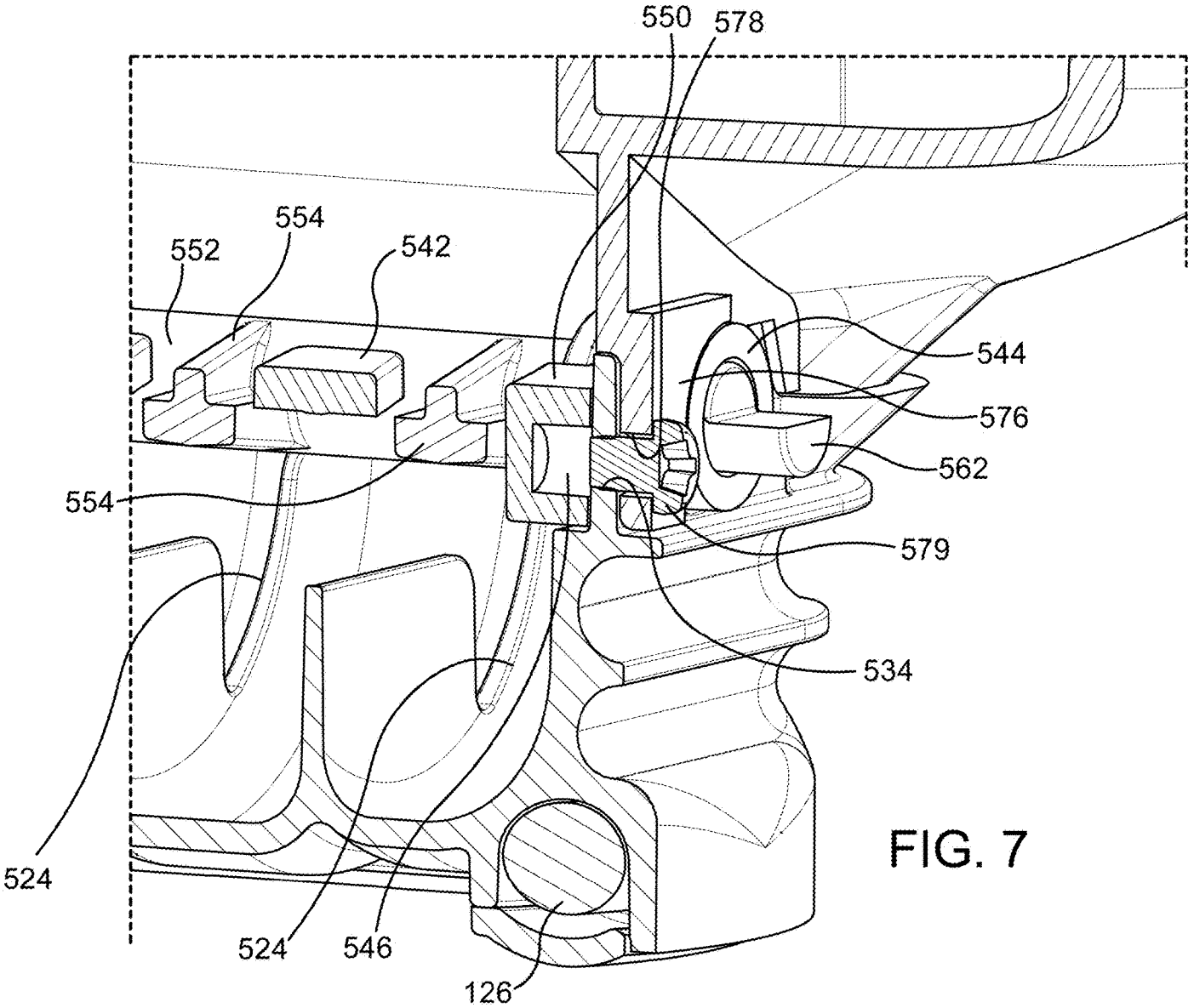
FIG. 7 is a section view of the ice tray assembly of FIG. 4.
Figure 9:
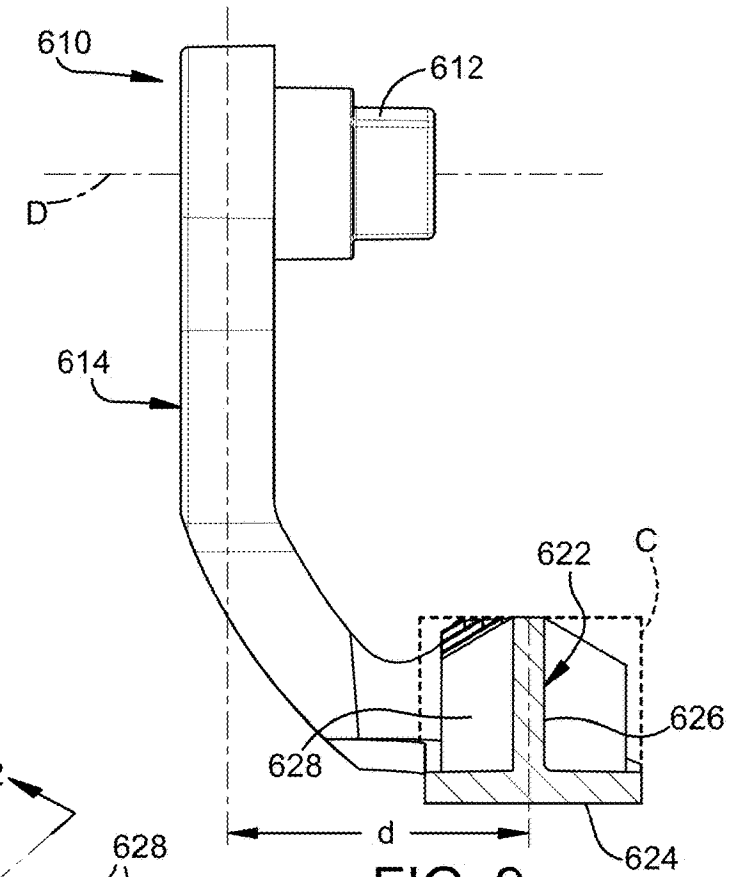
FIG. 9 is a section view taken along lines 22-22 of FIG. 8.

The bottom surface 514 of the ice mold 510 may be contoured to receive a heater 126 (shown in FIG. 7). For, example, the bottom surface 514 can include a groove (not shown) that extends about the periphery of the bottom surface 514 for receiving the heater 126 therein. The heater 126 can heat the ice mold 510 to thereby separate congealed ice pieces from the ice mold 510 during an ice harvesting operation. The heater 126 may be an electric resistive heater that may be captured in the groove formed in the bottom surface 514 of the ice mold 510. The heater 126 can be configured to be in direct or substantially direct contact with the ice mold 510 for increased conductive heat transfer. The heater 126 may be a U-shaped element that extends around a periphery of the bottom surface 514 and has a cylindrical outer surface. The legs of the U-shaped heater 126 may extend along the lateral direction of the ice mold 512. It is contemplated that the heater 126 may have other shapes, for example, but not limited to, circular, oval, spiral, etc., so long as the heater 126 is disposed in direct or substantially direct contact with the ice mold 510.

The lateral sides 516 of the ice mold 510 can be contoured or sculpted to receive an ice maker evaporator (not shown). For example, the lateral side surfaces 516 may include elongated recess (not shown) that closely matches the outer profile of the ice maker evaporator.

Figure 5:
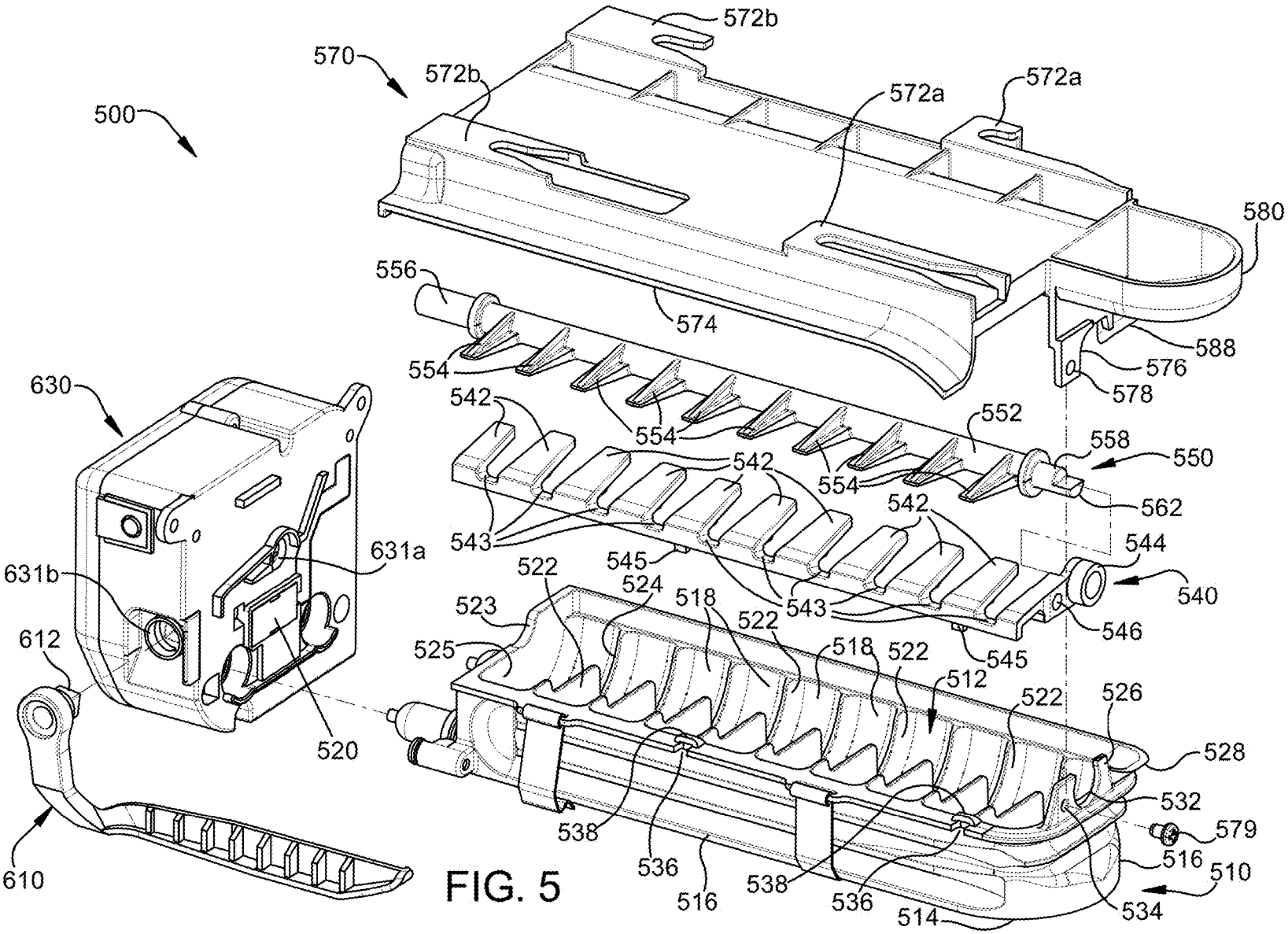
FIG. 5 is an exploded view of the ice tray assembly of FIG. 4.

Referring to FIG. 5, a support 544 is formed at an end of the ice stripper 540 that is received into a recess 532 of the ice mold 510. A hole 546 extends through a portion of the ice stripper 540 adjacent the support 544. The hole 546 is dimensioned and positioned to align with a hole 534 of the ice mold 510 when the support 544 is received into the recess 532 of the ice mold 510. The support 544 is dimensioned to allow the ice ejector 550 to rotate therein. The support 544 can act as a cylindrical bearing for allowing a matching portion of the ice ejector 550 to rotate therein.

The ice ejector 550, in general, is a rod-shaped element having a main body 552 with a plurality of fingers 554 extending from the main body 552. A first end 556 of the ice ejector 550 is dimensioned to be received into a first opening 631*a* of the gear box 630 to allow the first end 556 to engage an output gear 658 (shown in FIG. 11) inside the gear box 630, as described in detail below. The first end 556 rotates within the recess 523 in the ice mold 510. In this respect, the recess 523 in the ice mold 510 and the support 544 in the ice stripper 540 define bearing surfaces for allowing the ice ejector 550 to rotate about its longitudinal axis.

Figure 6:
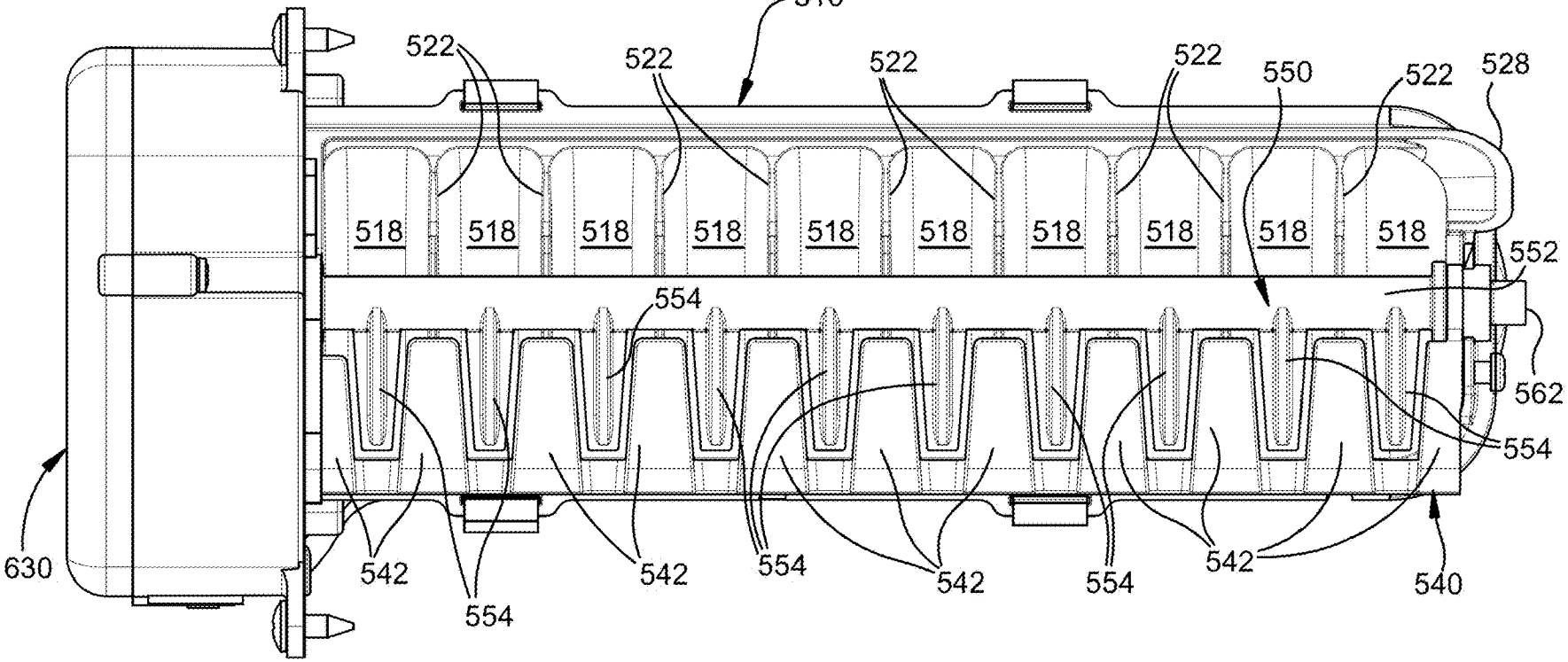
FIG. 6 is top view of the ice tray assembly of FIG. 4 with a cover of the ice tray assembly removed.

Referring to FIG. 6, the ice ejector 550 is positioned within the ice mold 510 and the ice stripper 540. The fingers 554 of the ice ejector 550 are dimensioned and positioned to align with the spaces between the tabs 542 of the ice stripper 540 and the cavities 518 in the ice mold 510. As the ice ejector 550 rotates about its longitudinal axis that the fingers 554 move through the cavities 518 in the ice mold 510 to force ice pieces (not shown) out of the cavities 518.

The projection 562 is fixed relative to the fingers 554 for allowing a controller 800 (FIG. 4) to ascertain the orientation of the fingers 554 (collectively referred to herein as the "ejector finger").

The controller 800 may be a part of the main control board of the refrigerator control system that controls a plurality of functions commonly associated with a refrigeration appliance, such as the temperature of the refrigeration compartments, activating the compressor and the condenser fan, and the like. Alternatively, the controller 800 may be a separate dedicated controller that is used substantially only for controlling the ice maker operations. For example, the controller 800 may be a separate controller arranged in the gear box 630 (FIG. 5).

The controller 800 can be an electronic controller and may include a processor. The controller 800 can include one or more of a microprocessor, a microcontroller, a digital signal processor (DSP), an application specific integrated circuit (ASIC), a field-programmable gate array (FPGA), discrete logic circuitry, or the like. The controller 800 can further include at least one timer that keeps track of, or counts, various time intervals described herein. The controller 800 can also include memory and may store program instructions that, when executed by the controller 800, cause the controller 800 to provide the functionality ascribed to it herein. Specifically, the controller 800 can be programmed to control the operations of the ice maker, the ice maker heater and the defrost heaters, among other refrigerator components, to carry out the control method described below. The memory may store different predetermined numbers of steps of rotation of the stepper motor, as described below. The memory may include one or more volatile, non-volatile, magnetic, optical, or electrical media, such as read-only memory (ROM), random access memory (RAM), electrically-erasable programmable ROM (EEPROM), flash memory, or the like. The controller 800 can further include one or more analog-to-digital (A/D) converters for processing various analog inputs to the controller.

The controller 800 can include input/output circuitry for interfacing with the various system components. For example, the controller 800 can receive and interpret temperature signals from various sensors, including but not limited to a Hall sensor 710, an ice maker temperature sensor, and a temperature sensor 520 (shown in FIG. 5), such as a negative temperature coefficient (NTC) thermistor, for example, that measures the temperature of the ice tray, and is used only during system defrost, for example. The controller 800 can process these signals to control the operation of ice maker, as well as other refrigeration and non-refrigeration components described above based on these signals. Specifically, based on these inputs, the controller 800 can control the status (on/off) of the ice maker and various ice maker modes, such as initialization, freeze, check bail arm, harvest, full-bucket, error modes, and defrost (which may be an ice maker defrost and/or a system defrost). Outputs of the controller 800 can be parameters related to the operation of the gearbox stepper motor, the ice maker defrost heater, the bistable valve (e.g., stepper valve), an air handler fan, the water valve, the auger motor, the ice selector, the compartment portion defrost heater, and the fill-tube heater.

Referring back to FIGS. 4 and 5, a D-shaped projection 562 can extend from the second end 558 of the ice ejector 550 such that a flat surface of the projection 562 is in a predetermined orientation when the ejector fingers 554 are in a "Home" position. In the "Home" position, the ejector finger 550 is horizontal, facing the ice stripper 540.

The "Home" position of the ejector finger 550 is not a single point or a specific angle, but rather refers to any angular position within a specified rotational range of the ejector finger 550 (e.g., from −23 to +5 degrees). For example, the "Home" position of the ejector finger 550 may be any position within the range from −23 to +5 degrees and any position within a range from 337 to 360 degrees. The remaining areas (outside the range from −23 to +5 degrees and the range from 337 to 360 degrees) can be programmed into the memory of the controller 800 as positions of the ejector finger 550 that are outside the "Home" position. These ranges are only examples, and other ranges may be programmed as the "Home" position and the positions outside the "Home" position of the ejector finger 550.

Referring to FIG. 5, a protrusion 612 extends from a distal end of the bail arm 610 and is dimensioned to a second opening 631*b* of the gear box 630. It is contemplated that the second opening 631*b* may align with an opening 704 in a drive shaft 702 (both shown in FIGS. 12 and 13) for allowing the drive shaft 702 to pivot the bail arm 610, as described in detail below.

Figure 8:
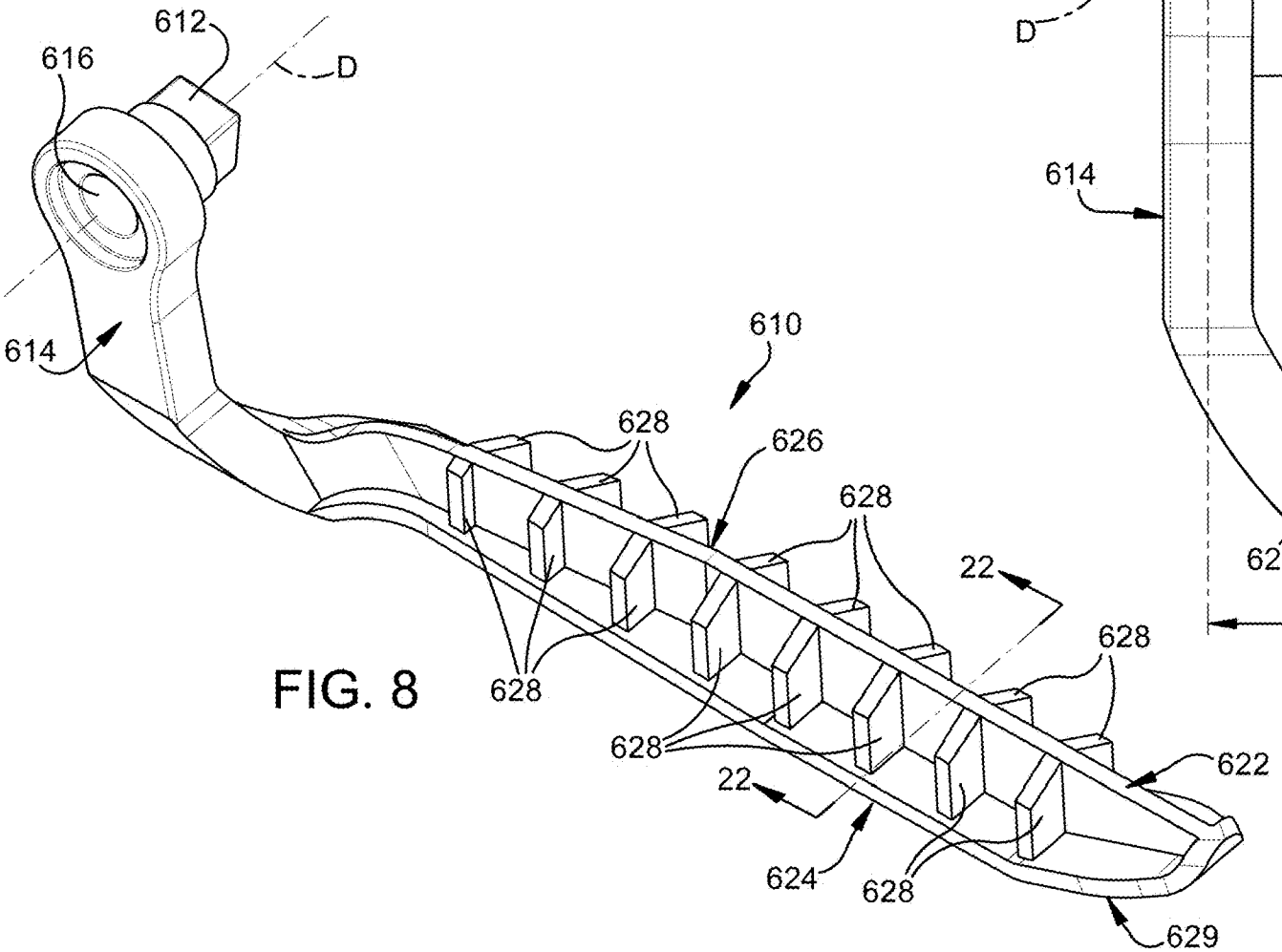
FIG. 8 is a side perspective view of the bail arm of the ice tray assembly of FIG. 4.

Referring to FIG. 8, the bail arm 610, in general, is an L-shaped element having a first leg 614 and a second leg 622. The bail arm 610 detects the presence and the level of ice stored in the ice bin 54 located next to the ice maker 50 (both shown in FIGS. 2 and 3). The protrusion 612 is disposed at a distal end of the first leg 614 for engaging the gear box 630. A fastener (not shown) may extend through a hole 616 that extends through the protrusion 612 for securing the bail arm 610 to the gear box 630. The second leg 622 extends from an opposite end of the first leg 614.

The second leg 622, in general, has a T-shaped cross-section (see FIG. 9) and includes a base portion 624 and a leg portion 626. A plurality of spaced-apart ribs 628 are positioned between the base portion 624 and the leg portion 626. The plurality of spaced-apart ribs 628 may be contoured to be within a rectangular space C defined by the base portion 624 and the leg portion 626 (see FIG. 9). The spaced-apart ribs 628 may be configured to provide structural support to the bail arm 610. In the embodiment illustrated, the spaced-apart ribs 628 are aligned to be parallel to a pivot axis D (see FIGS. 4 and 8-9) of the bail arm 610. The pivot axis D is defined by the hole 616.

A distal end of the second leg 622 is angled relative to the remaining portion of the second leg 622 to define an angled pad 629. It is contemplated that the angled pad 629 may be dimensioned and positioned to engage ice pieces that are disposed in the ice bin 54 (FIG. 3), as described in detail below.

Figure 11:
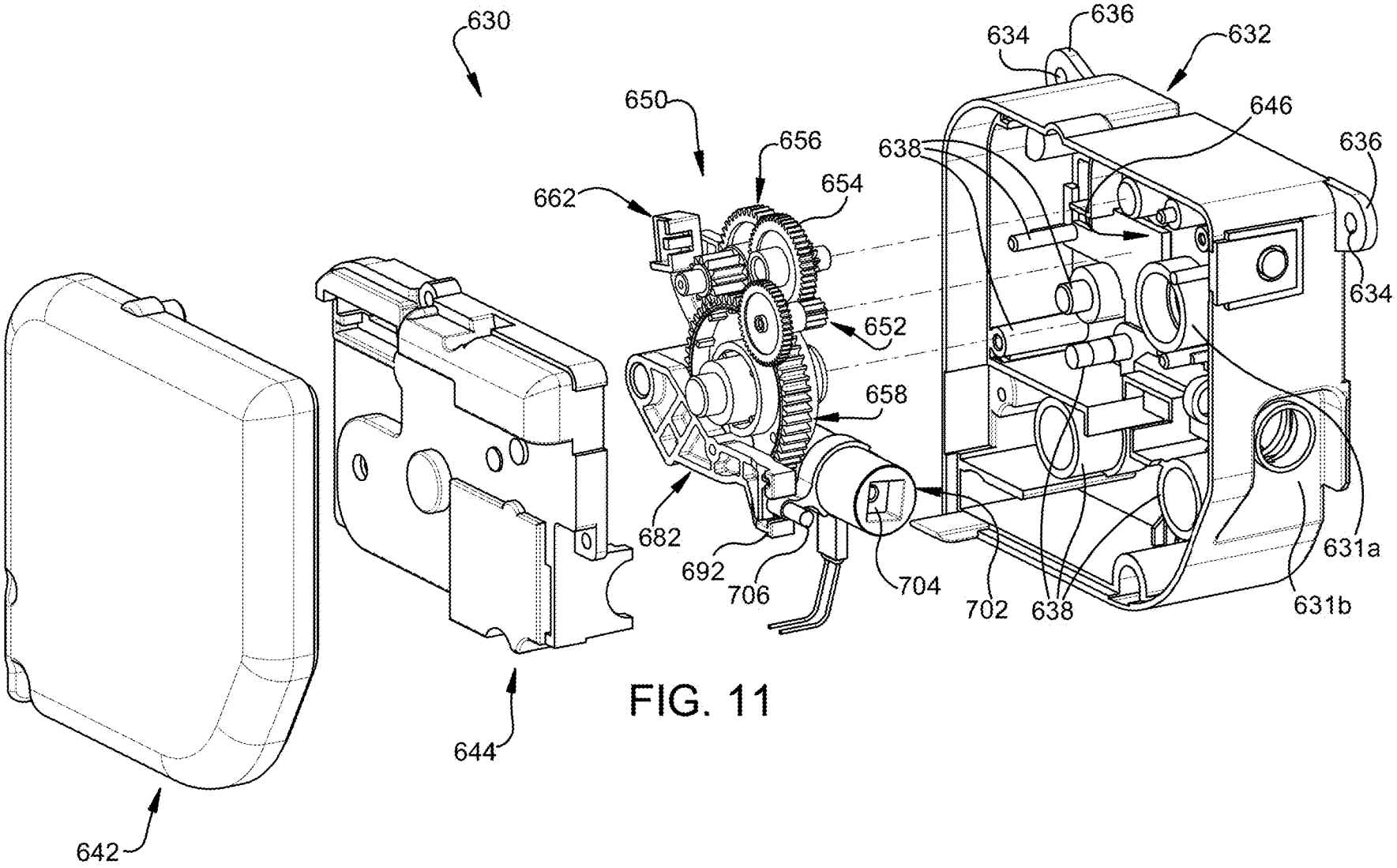
FIG. 11 is an exploded view of a gear box of FIG. 4.

Referring to FIG. 11, the gear box 630 includes a housing 632, a cover 642, an intermediate cover 644 and a gear mechanism assembly 650. A motor (not shown) and a drive gear (not shown) are disposed in an area 646 of the housing 632. The drive gear may be attached to an output shaft (not shown) of the motor for transferring rotational movement to the gear mechanism assembly 650. An intermediate cover 644 is disposed in the housing 632 and defines a chamber for receiving the gear mechanism assembly 650 and enclosing the area 646 wherein the motor (not shown) and the drive gear (not shown) are disposed.

During operation of the ice maker, the controller 800 may energize the motor to rotate, which causes the ice ejector 550 (FIG. 5) to rotate about its longitudinal axis. The motor can be a stepper motor, such as a brushless DC electric motor, that divides a full 360-degree rotation into a number of equal rotational steps, for example. At least certain numbers of steps corresponding to different amounts of rotation of the motor can be programmed and saved in the memory of the controller 800 and used to control the operation of the ice maker as described below. For example, a predetermined number of rotational steps of the stepper motor can be programmed into the memory of the controller 800 to correspond to the amount of rotation of the motor that causes the ice ejector 550 to rotate a certain number of degrees around a circle. The degrees of rotation (and corresponding steps) can cause the ejector finger 550 to rotate from a known or assumed position to a desired position, such as the "Home" position range, positions outside the "Home" position, a position detecting the position of the bail arm 610, etc. Examples of degrees of rotation and corresponding steps in different situations are described below.

Figure 13:
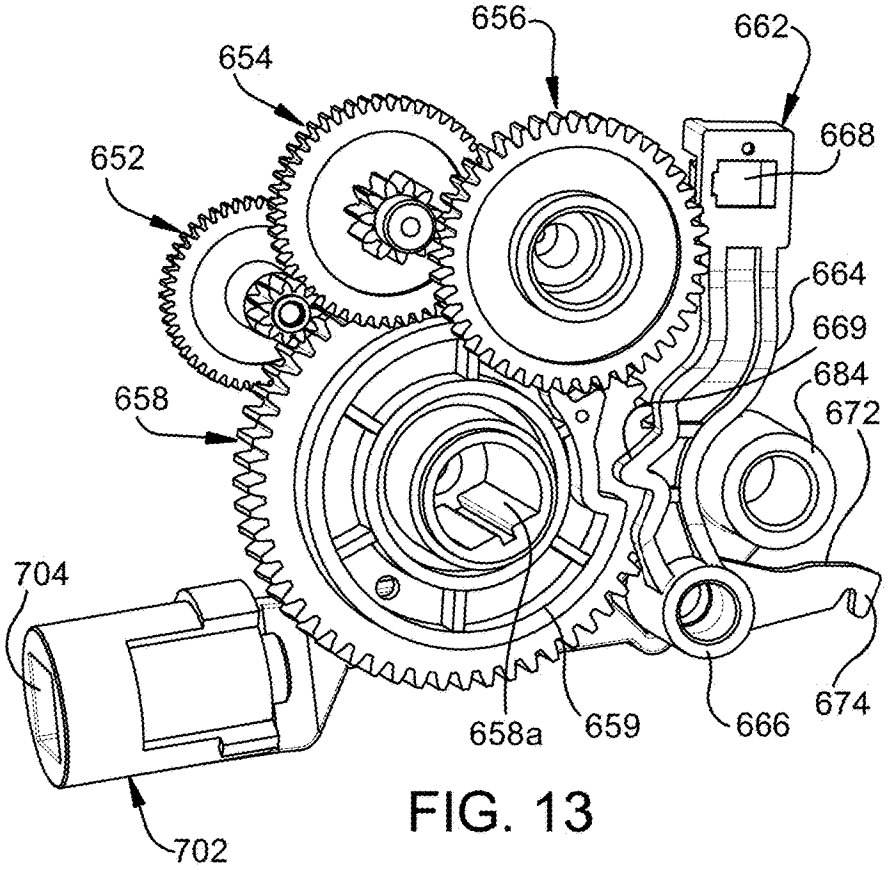
FIG. 13 is a rear perspective view of the gear mechanism assembly of FIG. 12.
Figure 12:
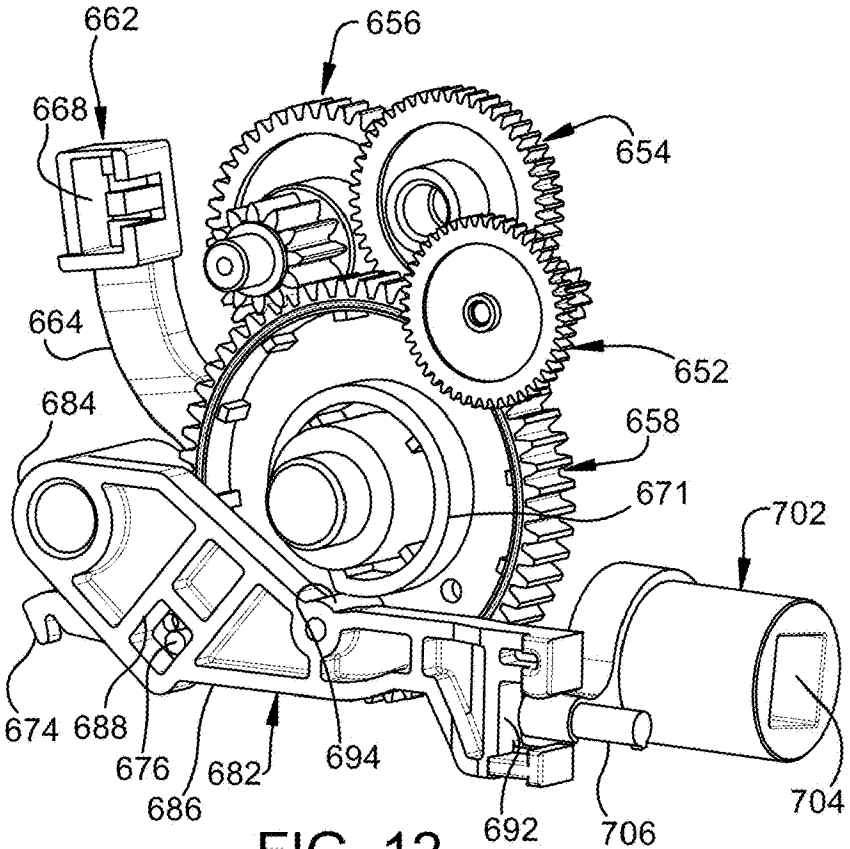
FIG. 12 is a front perspective view of a gear mechanism assembly of the gear box of FIG. 4.

Referring to FIGS. 12 and 13, the gear mechanism assembly 650 includes a first gear 652 that meshes with the drive gear (not shown) attached to the motor (not shown). The first gear 652 drives a first intermediate gear 654, which in turn drives a second intermediate gear 656. The second intermediate gear 656 drives an output gear 658. The output gear 658 includes an opening 658*a* that is dimensioned to align with the first opening 631*a* in the housing 632. The first end 556 of the ice ejector 550 (FIG. 5) extends through the first opening 631*a* and engages the opening 658*a* of the output gear 658.

Via the first gear 652, the first and second intermediate gears 654, 656 and the output gear 658, rotation of the motor causes the ice ejector 550 to turn in the desired direction—clockwise (CW) direction (also referred to as "first direction") or counter-clockwise (CCW) direction (also referred to as "second direction").

The drive gears 652, 654, 656, and 658 can continue to move, and the motor can continue to rotate through the steps, regardless whether the ice ejector 550 is blocked and unable to move. In other words, the motor can keep rotating even if the ice ejector 550 is not moving.

The gear mechanism assembly 650 also includes a first lever arm 662 that is pivotably attached inside the gear box 630. The first lever arm 662 includes a first leg 664 extending from a central pivot body 666 of the first lever arm 662. A pocket 668 is formed in a distal end of the first leg 664. The pocket 668 is dimensioned to receive a magnetic element (not shown). A protrusion 669 extends from a side of the first leg 664 and is positioned to engage a first cam 659 on one side of the output gear 658, as described in detail below.

A second leg 672 extends from the central pivot body 666 and includes a hook portion 674 configured to attach to a spring (not shown). The spring biases the first lever arm 662 into a first position, shown in FIGS. 14A, 14C, 15A, 15C. The first lever arm 662 also includes a post 676 (FIG. 12) that engages a pocket 688 formed in a second lever arm 682, as described in detail below.

The second lever arm 682 includes a central pivot body 684 and an arm portion 686 attached to the central pivot body 684. The pocket 688 is positioned and dimensioned to receive the post 676 of the first lever arm 662. A receiver 692 is formed at a distal end of the arm portion 686 for engaging a post 706 extending from a drive shaft 702, as described in detail below. A protrusion 694 extends from one side of the arm portion 686 and is positioned to engage a second cam 671 on a side of the output gear 658 opposite to the first cam 659.

The drive shaft 702 includes an opening 704 that is dimensioned to receive the protrusion 612 on the distal end of the bail arm 610. The opening 704 is positioned to align with the second opening 631*b* of the gear box 630 (FIG. 11) when the drive shaft 702 is positioned in the housing 632. The post 706 extending from the drive shaft 702 is dimensioned and positioned to be received into the receiver 692 of the second lever arm 682. The post 706 is attached to a spring (not shown) that biases the drive shaft 702 to a first rotated position corresponding to the bail arm 610 being in a second lower position B, as described in detail below.

Figure 10:
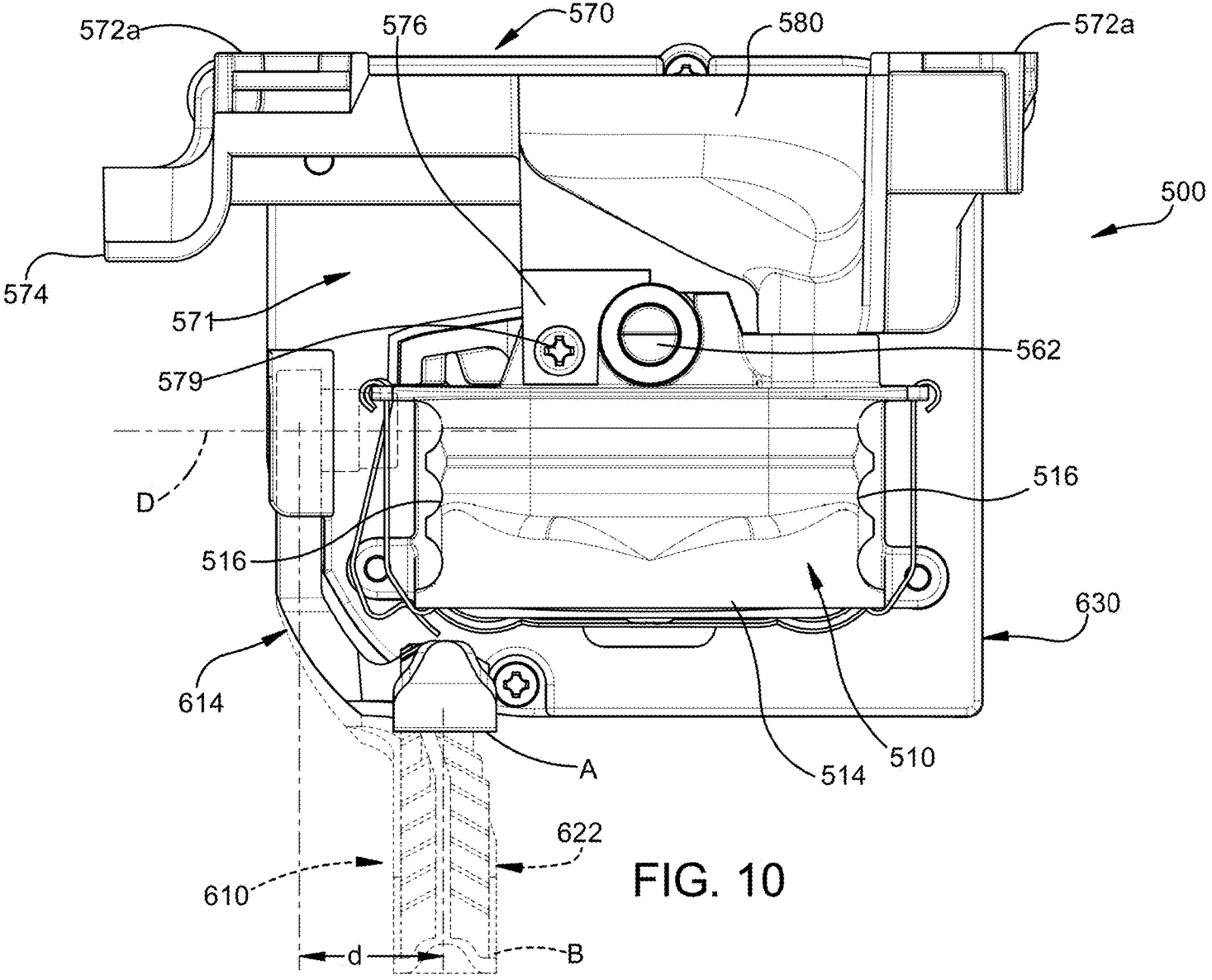
FIG. 10 is an end view of the ice tray assembly of FIG. 4 illustrating the bail arm in both the first, upper position and the second, lower position.

During operation of the ice tray assembly 500, the controller 800 may first actuate the bail arm 610 to determine whether ice needs to be added to the ice bin 54 (FIG. 3). To determine this, the controller 800 may energize the motor (not shown) in the gear box 630 to cause the bail arm 610 to pivot from a first upper position A to the second lower position B, as shown in FIGS. 4 and 10 about the pivot axis D. If the bail arm 610 contacts ice pieces prior to reaching the second lower position B (e.g., as determined by an increase in the power required to pivot the bail arm 610 or a combination of gears, linkages and sensors for determining when the bail arm 610 contacts ice pieces) the controller 800 may cause the bail arm 610 to be returned to the first upper position A. Accordingly, the controller 800 may then prevent the harvesting of ice pieces from the ice tray assembly 500 to the ice bin 54. However, if the bail arm 610 reaches the second lower position B without contacting ice pieces, then the controller 800 may cause the ice tray assembly 500 to harvest ice pieces into the ice bin 54 (FIG. 3). According to one aspect, the controller 800 may control the gear box 630 in the following manner to detect whether the ice bin 54 is full or empty.

Figure 14A:
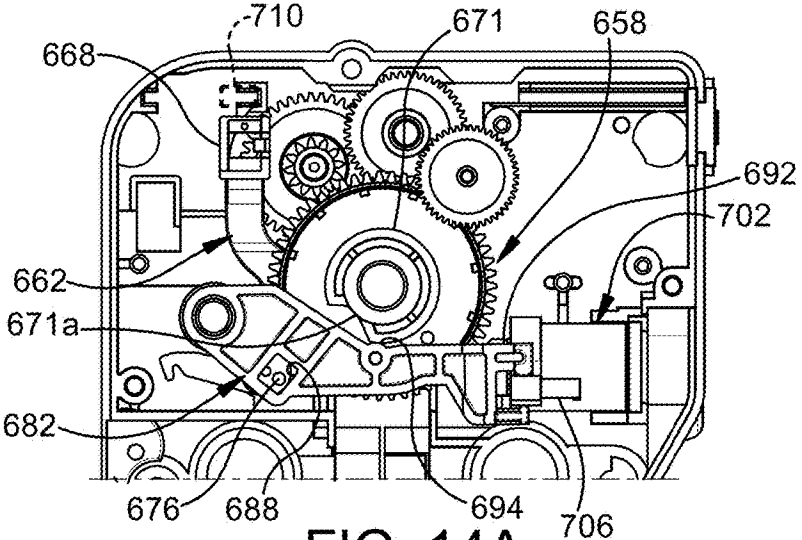
FIGS. 14A-14D are front views of the gear box of FIG. 11 with a cover and an intermediate cover removed, illustrating the gear mechanism assembly in various states of operation for determining a condition of an ice bin.
Figure 14B:
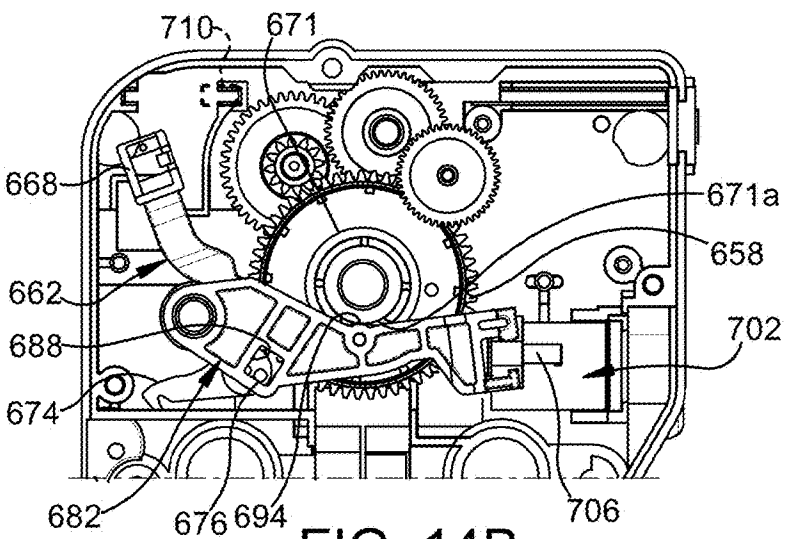
Figure 14C:
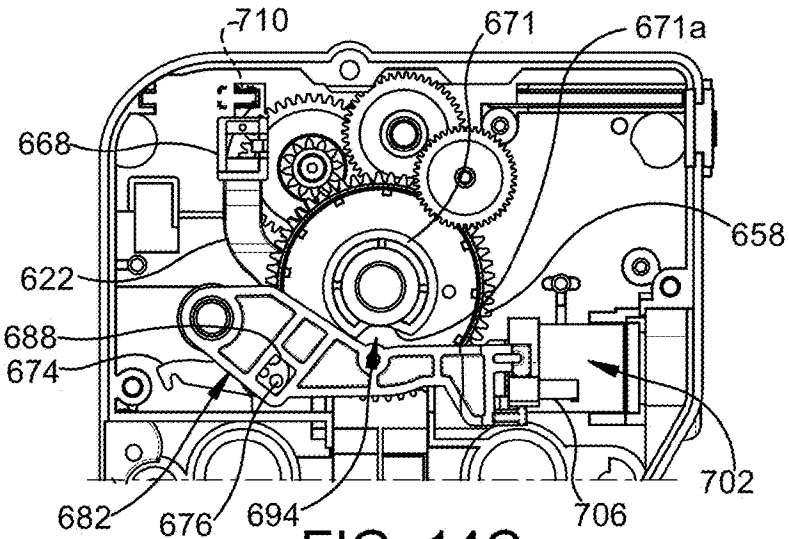
Figure 14D:
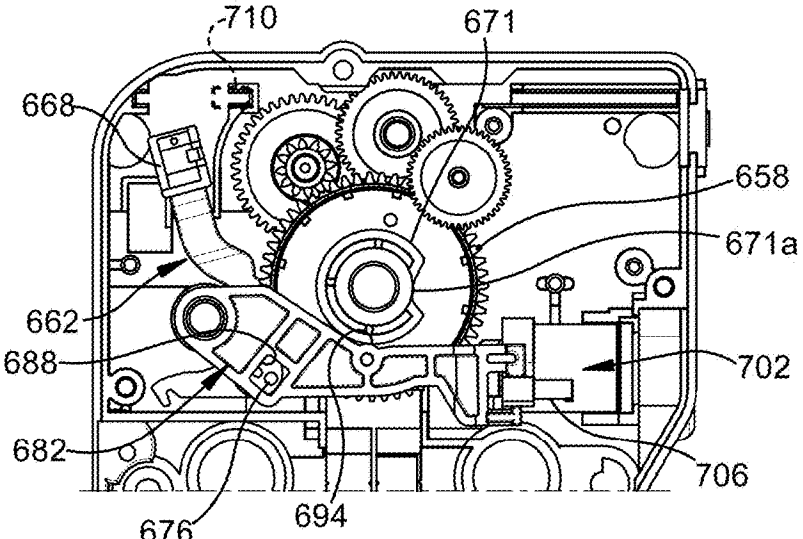

Referring to FIGS. 14A-14B, the gear box 630 includes a Hall sensor 710 that may be mounted to a printed circuit board (PCB) (not shown) that is disposed in the housing 632. The Hall sensor 710 detects the position of the bail arm 610 and the position of the ejector finger 550, as described below. The Hall sensor provides either a HIGH signal or a LOW signal to the control system of the ice maker (e.g., to the controller 800). When the ejector finger 550 and the bail arm 610 are in the so called "Home" position and the ice bin is full of ice, the signal from Hall sensor 710 will be LOW. When the ejector finger 550, the bail arm 610, and the ice level are in other conditions (e.g., when the ejector finger 550 is outside the "Home" position or the ice bin is empty), the signal from the Hall sensor 710 will be HIGH.

Figure 15A:
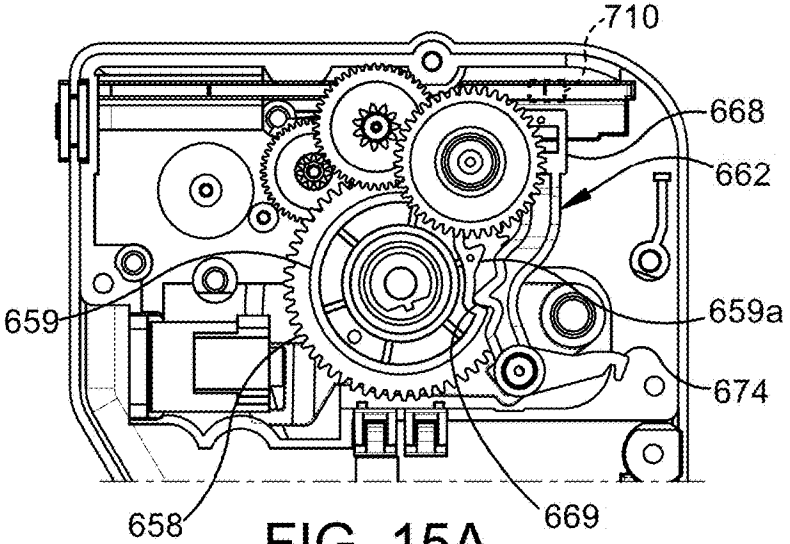
FIGS. 15A-15D is a rear view of the gear box of FIG. 11 with a housing removed, illustrating the gear mechanism assembly in various states of operation for determining a condition of an ice bin.

Referring to FIGS. 14A and 15A, the first and second lever arms 662, 682 are shown in a first position, as referred to as a "Home" position. In this first position, the spring (not shown) attached to the hook portion 674 of the first lever arm 662 biases the distal end of the first lever arm 662 (which includes the pocket 668 for receiving the magnetic element (not shown)) to a first position adjacent the Hall sensor 710. When the magnetic element is positioned adjacent the Hall sensor 710, based on the Hall effect of the generated voltage, the Hall sensor 710 provides a LOW signal as an input to the controller 800. A LOW input signal from the Hall sensor 710 indicates that the ejector finger 550 is in the "Home" position and the position of the bail arm 610 indicates a full ice bucket.

Further, the first lever arm 662 is allowed into the first position because the protrusion 669 on the first lever arm 662 is received into a recess 659*a* (FIGS. 15B, 15C and 15D) of the first cam 659 on the output gear 658. The position of the ejector finger 550 in the recess 659*a* may be programmed into the memory of the controller 800 as the lowest position (e.g., −23 degrees) in the "Home" position range of −23 to 5 degrees. The position of the ejector finger 550 in the protrusion 669 may be programmed into the memory of the controller 800 as the highest position (e.g., −23 degrees) in the "Home" position range of −23 to 5 degrees.

The motor rotates the ejector finger 550 until the output from the Hall sensor 710 changes (from LOW to HIGH, and vice versa) or for a predetermined preprogrammed number of steps, whichever comes first. The controller 800 can be programmed to detect that the ejector finger 550 is at the edge of the "Home" area when the output from the Hall sensor 710 changes. If the ejector finger 550 is in the "Home" position and the motor rotates for a predetermined number of steps, the ejector finger 550 will rotate out of the "Home" position, unless there is a problem (e.g., something is blocking the ejector finger 550). Likewise, if the ejector finger 550 is outside the "Home" position and the motor rotates for a predetermined number of steps, the ejector finger 550 will rotate to the "Home" position, unless there is a problem (e.g., something is blocking the ejector finger 550).

The controller 800 can be programmed to monitor and detect the input signal from the Hall sensor 710 at all times. During ice making, water fill, full bucket mode, and at the beginning of "check bail arm" or "harvest" mode, the input signal from the Hall sensor 710 should always be LOW. The input signal from the Hall sensor 710 can change according to the intended movement of the ejector finger 550. For example, before the stepper motor starts to rotate, the input signal from the Hall sensor 710 should be LOW, and after a certain number of rotating steps, the input signal from the Hall sensor 710 can change to HIGH. If the controller 800 detects a HIGH input signal from the Hall sensor 710 when such input is not intended, the controller 800 will cause the ice maker to enter an error mode, as described below. A timeout can occur when the motor rotates for a predetermined number of steps and there is no change of state of the Hall sensor 710.

In addition, the protrusion 694 on the second lever arm 682 engages the second cam 671 on the output gear 658 such that the second lever arm 682 is in the first position. When in the first position, the second lever arm 682 is pivoted downward (relative to FIG. 14A) such that the drive shaft 702 is positioned in a second rotated position that corresponds to the bail arm 610 being in the upper position A (FIG. 4).

Figure 15B:
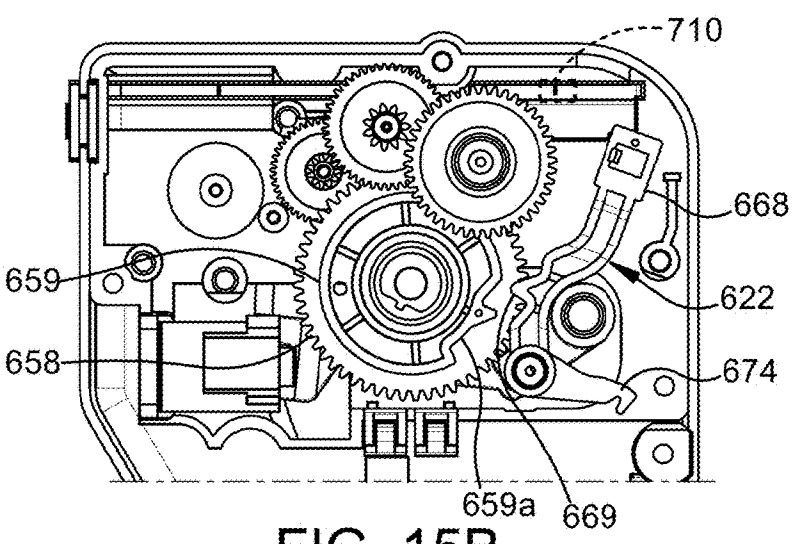

As the output gear 658 rotates in the counter-clockwise direction (with reference to FIGS. 14A-14D) the output gear 658 is eventually positioned such that the protrusion 694 on the second lever arm 682 aligns with a recess 671*a* in the second cam 671. In this position, the spring (not shown) attached to the post 706 of the second lever arm 682 causes the drive shaft 702 to rotate the bail arm 610 from the first upper position A toward the second lower position B. If the bail arm 610 is able to reach the second lower position B, then the first lever arm 662 and the second lever arm 682 will be positioned as shown in FIGS. 14B and 15B. In particular, the protrusion 694 on the second lever arm 682 will bottom out in the recess 671*a* so that the second lever arm 682 pivots to a second position. As the second lever arm 682 pivots, the pocket 688 in the second lever arm 682 will engage the post 676 on the first lever arm 662 and cause the first lever arm 662 to pivot to a second position. In the second position, the pocket 668 (and the magnetic element therein) in the first lever arm 662 are positioned away from the Hall sensor 710. When the magnetic element is positioned away from the Hall sensor 710, the Hall sensor 710 will send a signal indicative of HIGH to the controller 800.

Figure 15C:
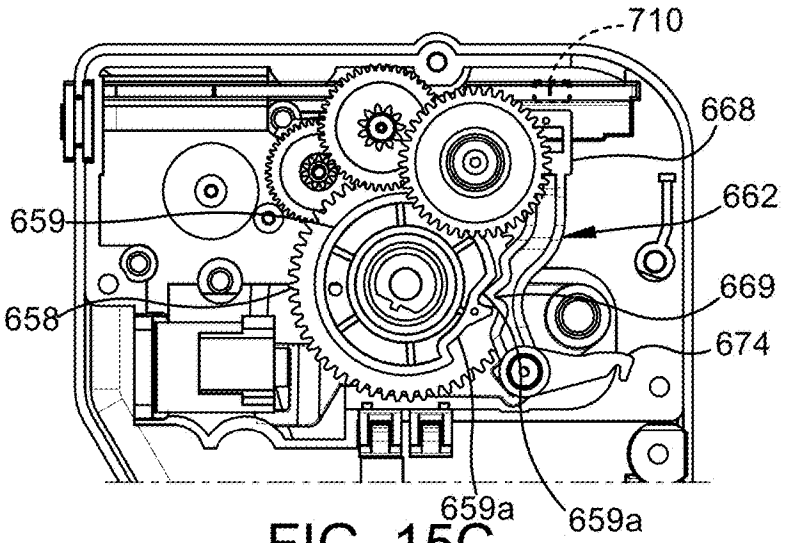
Figure 15D:
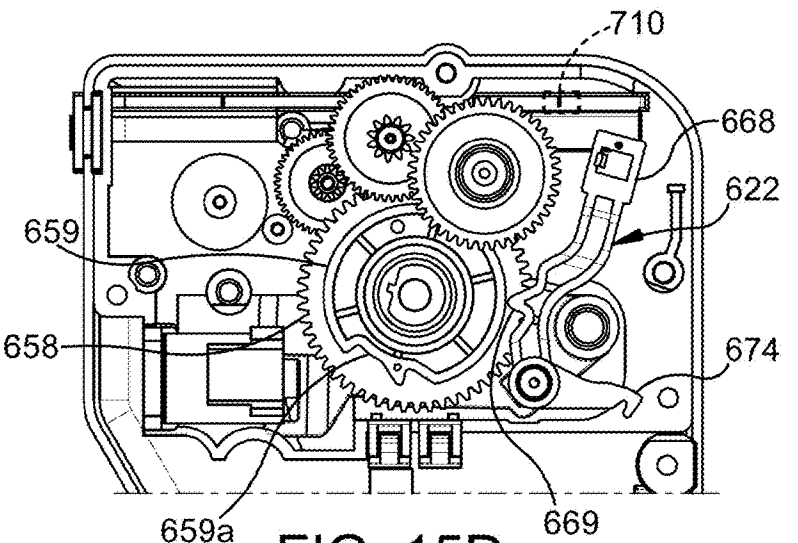

In contrast, if the bail arm 610 is not able to reach the second lower position B, e.g., it contacts ice pieces in the ice bin 54, then the protrusion 694 will not bottom-out in the recess 671*a* and the second lever arm 682 will remain in the first position. See FIGS. 14C and 14B. In this position the pocket 668 (and the magnetic element therein) will remain adjacent the Hall sensor 710 and the Hall sensor 710 will send a signal indicative of LOW to the controller 800. As illustrated in FIG. 15C, the protrusion 669 on the first lever arm 662 will be positioned in the recess 659*a* such that the first lever arm 662 will remain in the first position.

As the output gear 658 continues to rotate in the counter-clockwise direction (with reference to FIGS. 14A-14D), the protrusion 694 of the second lever arm 682 will continue to ride on the second cam 671 and maintain the second lever arm 682 in the first position and the bail arm in the first upper position A. The protrusion 669 on the first lever arm 662 will ride on the first cam 659 and cause the first lever arm 662 to pivot to the second position. In this second position the pocket 668 (and the magnetic element therein) will pivot away from the Hall sensor 710. When the magnetic element is moved from the Hall sensor 710, the Hall sensor 710 will send a signal indicative of HIGH to the controller 800.

As described above, as the output gear 658 rotates in the counter-clockwise direction (with reference to FIGS. 14A-14D), the signal from the Hall sensor 710 will change between HIGH and LOW based on the position of the ejector finger 550 and based on whether the ice bin 54 is full or less than full. In particular, the sequence of the changes between HIGH and LOW will depend on whether the ejector finger 550 is in the "Home" position and whether the ice bin 54 is full or less than full. The controller 800 can be programmed such that, based on the sequence of changes between HIGH and LOW of the Hall sensor 710, the controller 800 can determine whether the ejector finger 550 is in the "Home" position and whether the ice bin 54 is full or less than full.

If the ice bin 54 is less than full, the ice pieces are harvested from the ice mold 510. In particular, the motor associated with the gear box 630 may cause the ice ejector 550 to rotate such that the fingers 554 move through the cavities 518. As the fingers 554 move through the cavities 518, they force the ice pieces in the cavities 518 out of the ice mold 510. When viewed from the end of the ice tray assembly 500 opposite the gear box 630 (see FIG. 10), the ice ejector 550 is rotatable in a counter-clockwise direction such that the ice ejector 550 forces the ice pieces into an area above the ice mold 510. A lower surface of the cover 570 is curved to direct the ice pieces toward the opening 571 between the cover 570 and the ice mold 510. As the ice ejector 550 continues to rotate, the ice pieces are then ejected from the ice tray assembly 500 into the ice bin 54 (FIG. 3) positioned below the ice tray assembly 500.

Referring to FIG. 10, during the ejection of the ice pieces from the ice mold 510, the bail arm 610 is in the first upper position A. In particular, the first leg 614 is positioned adjacent a side of the gear box 630 and the second leg 622 is positioned underneath the ice mold 510. The ice mold 510 functions as a shield to prevent the ice pieces from striking the second leg 622 of the bail arm 610 as the ice pieces fall toward the ice bin 54 (FIG. 3).

The ice maker control method described below provides different steps to detect and remove ice that may be interfering with the movement of the ejector finger 550. As a result, the ice maker control method described below ensures a reliable ice maker initialization, two error (e.g., failure) modes, and an ice maker defrost mode, in addition to the water fill, freeze, and harvest operations of the ice maker.

For example, as described above, the controller 800 can determine whether the ice ejector 550 is at the "Home" position by receiving a signal from the Hall sensor 710. Based on the signal received from the Hall sensor 710, the controller 800 can determine that the ice ejector 550 is not rotating in one of the first direction or in the second direction when the status of the Hall sensor 710 does not change from LOW to HIGH at some time during the rotation of the motor. When it is detected that, although the motor continues to rotate for a predetermined number of steps, the ice ejector 550 is not rotating in one of the first direction or in the second direction, the controller 800 can determine that an error condition (e.g., a timeout) has occurred because the ejector finger 550 has either not left the "Home" position or has not reached the "Home" position. The controller 800 can then issue commands to various components of the ice maker to remedy the error condition, as described below.

Figure 16:
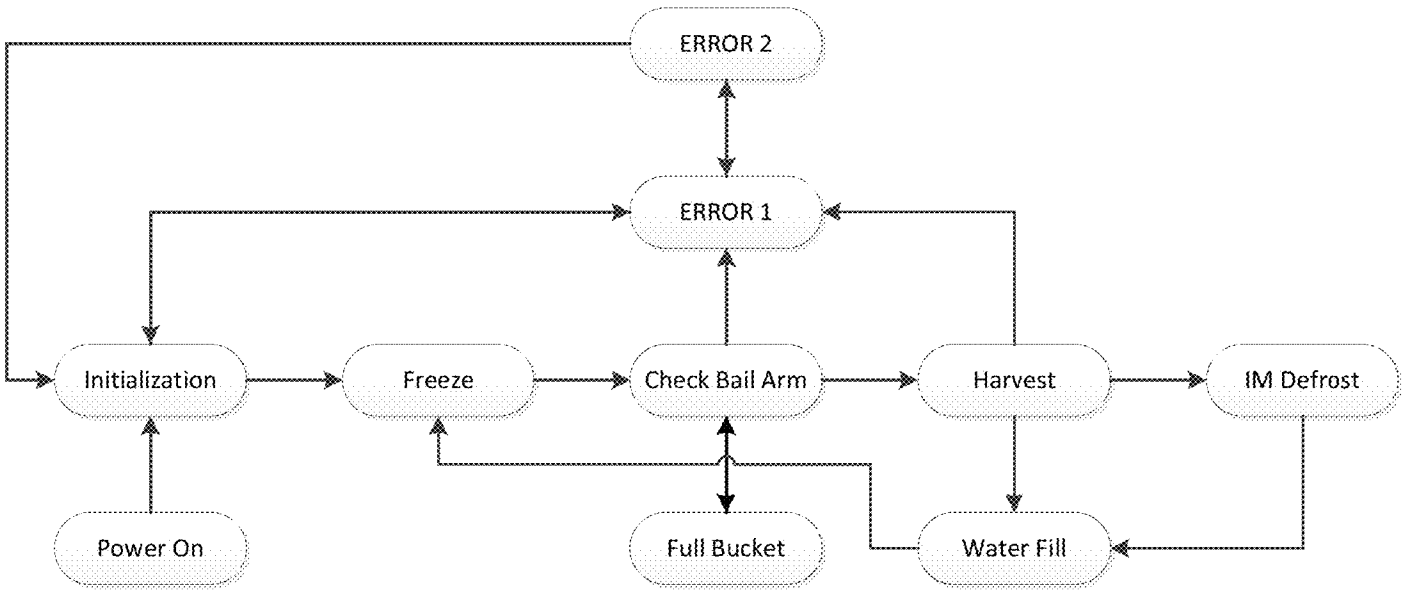
FIG. 16 is a flowchart illustrating the overall control flow of the ice maker.

Referring to FIG. 16, when the ice maker is first turned ON ("Power ON") and when the input signal from the Hall sensor 710 is LOW (e.g., indicating that the ejector finger 550 is in the "Home" position), the controller 800 causes the ice maker to enter an ice maker initialization mode. During initialization, the motor rotates the ejector finger 550 and the Hall sensor 710 seeks two Hall sensor HIGH signal boundaries to verify whether the ejector finger 550 is within the range of the "Home" position. Then, the motor rotates the ejector finger 550 until the ejector finger 550 is in the "Home" position (i.e., the ejector finger 550 is horizontal, facing the ice stripper 540). When it is detected that, although the motor continues to rotate, the Hall sensor 710 cannot verify the two Hall sensor HIGH signal boundaries indicating that the ejector finger 550 is within the range of the "Home" position (e.g., failed verification), the controller 800 can determine that an error condition has occurred.

After the ejector finger 550 reaches the "Home" position, the controller 800 causes the ice maker to enter a "Freeze" mode. During the "Freeze" mode, the compressor of the refrigerator is turned on and the air handler fan circulates cold air over the water in the ice tray 510 (FIGS. 4 and 5) to freeze the water into ice cubes (the ice maker makes ice).

During the "Full Bucket" mode, the ice bin is full of ice. The controller 800 stops the ice making process and cycles the air handler fan on and off to maintain the temperature of the ice tray at a predetermined temperature.

If any of the "HOME" verification steps fails or if the controller 800 determines that the motor rotates in one of the first direction or in the second direction for a predetermined number of steps (such as the first or second predetermined number of steps described below), but there is no change in the status of the Hall sensor 710 (from LOW to HIGH, and vice versa), the controller 800 determines that an error condition has occurred and causes the ice maker to enter an error mode, such as the first error mode (ERROR 1), for example, as described below.

In other words, the controller 800 determines that an error condition has occurred and causes the ice maker to enter the first error mode (ERROR 1) when there is a timeout (e.g., there is no change in the status of the Hall sensor 710 during rotation of the motor for a predetermined number of steps) or when any verification fails. Specifically, the controller 800 checks whether the input signal from the Hall sensor 710 is HIGH or LOW, whether the input signal from the Hall sensor 710 is HIGH or LOW for a certain number of steps relative to the "Home" position of the ice ejector 550, and whether the ice bucket is full.

If the Hall sensor 710 is not LOW (e.g., if the Hall sensor 710 is HIGH, indicating that the ejector finger 550 is not in the "Home" position), the controller 800 causes the ice maker to enter an initialization failure recovery mode. During the initialization failure recovery mode, the motor rotates the ejector finger 550 in the CCW direction until the Hall sensor 710 is LOW. If the status of the Hall sensor 710 does not change from HIGH to LOW during the rotation of the motor for the second predetermined number of steps, the controller 800 causes the ice maker to enter the first error mode (ERROR 1).

If the status of the Hall sensor 710 changes from HIGH to LOW during the rotation of the motor for the second predetermined number of steps, the controller 800 causes the ice maker to re-enter the ice maker initialization mode.

If the controller 800 determines that, during rotation of the motor, the ice ejector 550 is not rotating in one of the first direction or in the second direction, the controller 800 can cause the ice maker to enter a first error mode (shown as "ERROR 1" in FIGS. 16, 17A-B, and 21).

As described above, in certain situations, the motor rotates for a predetermined number of steps, but the controller 800 detects that there is no change of state of the Hall sensor 710, which indicates that the ejector finger 550 cannot rotate either in the counter-clockwise (CCW) direction or in the clockwise (CW) direction during the rotation of the motor, possibly due to blockage in the ice tray. In this situation, the controller 800 causes the ice maker to enter a first error mode (ERROR 1).

Figure 17A:
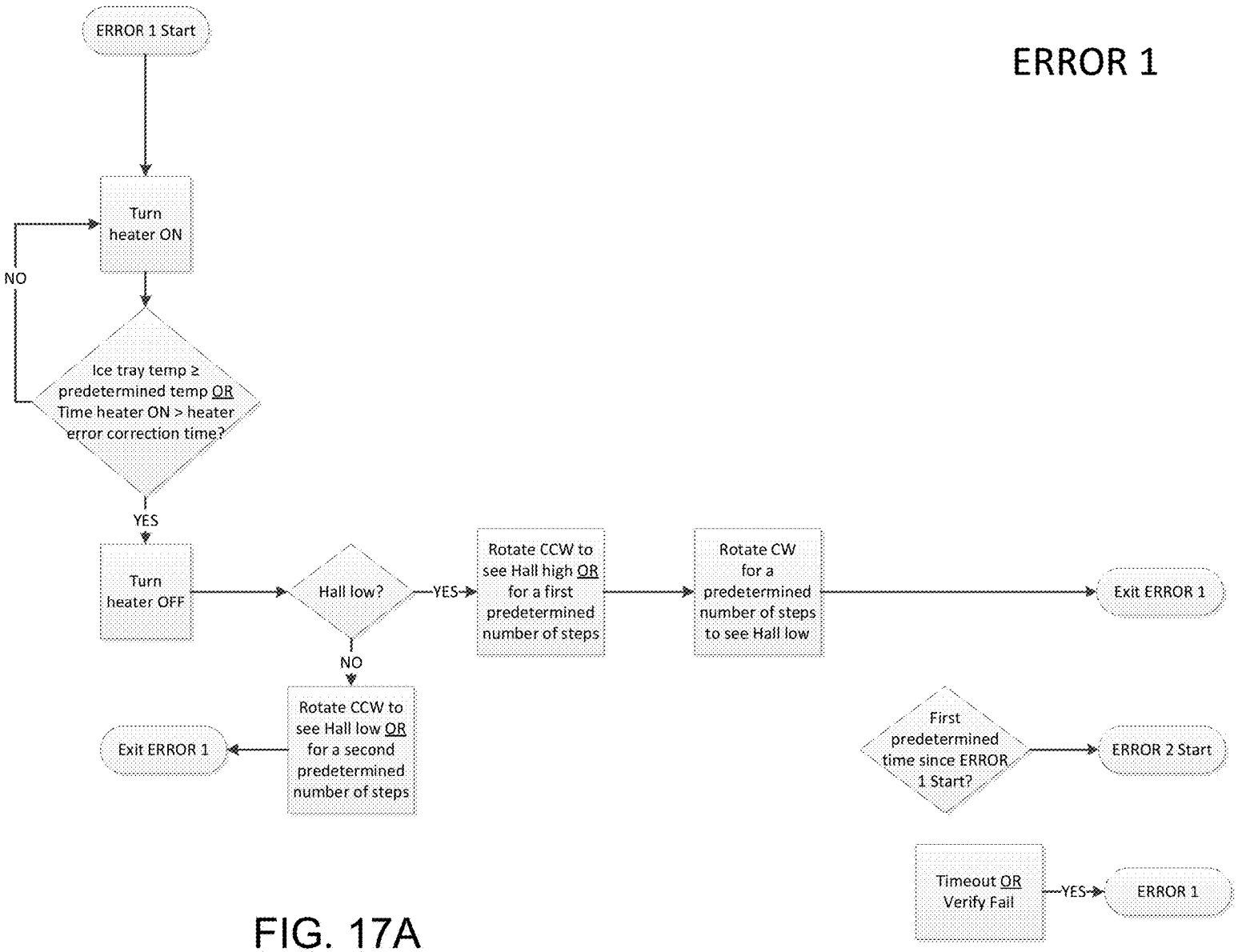
FIG. 17A is a flowchart illustrating the ice maker's first error mode.

Referring to FIG. 17A, during the first error mode (ERROR 1), the controller 800 turns on the ice maker heater 126 (shown in FIG. 7) to melt any ice blockage that might be interfering with the rotation of the ejector finger 550. The controller 800 turns off the ice maker heater 126 when a predetermined ice maker heater error correction time has elapsed or when the ice tray temperature is equal to or greater than a first predetermined temperature (e.g., 2° C., for example). The predetermined ice maker heater error correction time may be a predetermined period of time that would be sufficient to at least partially melt ice in the ice tray 510 that may be interfering with the movement of the ejector finger 550. The controller 800 then checks whether the ejector finger 550 is at the "Home" position (i.e., the Hall sensor 710 is LOW). If the Hall sensor 710 is LOW (path "Yes" in FIG. 17A), the motor rotates in the second direction or in the counter-clockwise (CCW) direction until the ejector finger 550 is not at the "Home" position (i.e., the Hall sensor 710 is HIGH) or for a first predetermined number of steps, whichever occurs first. The first predetermined number of steps may be programmed in the memory of the controller 800 as a sufficient number of rotational steps of the motor that would allow the ejector finger 550 to leave the "Home" position at some point during rotation of the motor when the starting position of the ejector finger is within the "Home" position, for example 28 degrees (when the "Home" position has a range of 28 degrees). Then, the motor rotates slightly back in the first direction or in the clockwise (CW) direction until the ejector finger 550 is at the "Home" position (the Hall sensor 710 is LOW).

An error condition can occur when the motor rotates for a first predetermined number of steps, and there is no change of the status of the Hall sensor 710. For example, in the first error mode (ERROR 1), if the motor rotates in the counter-clockwise (CCW) direction for the first predetermined number of steps and the status of the Hall sensor 710 does not change from LOW to HIGH, the controller 800 will detect an error condition, which can indicate that the ejector finger 550 has not left the "Home" position and that the rotation of the ejector finger 550 may be blocked due to ice accumulation in the ice tray 500, for example. Likewise, if the motor rotates slightly back in the first direction or in the clockwise (CW) direction and the status of the Hall sensor 710 does not change to LOW within a predetermined number of steps, the controller 800 will detect an error condition, which can indicate that the ejector finger 550 has not reached the "Home" position and that the rotation of the ejector finger 550 may be blocked due to ice accumulation in the ice tray 500, for example. When detecting any timeout (e.g., there is no change in the status of the Hall sensor 710 during rotation of the motor for a predetermined number of steps), the controller 800 causes the ice maker to restart the first error mode (ERROR 1), and the steps illustrated in FIG. 17A are repeated from the beginning.

If, after rotating the motor in the first direction or in the second direction, the ejector finger 550 is at the "Home" position within a first predetermined time (e.g., 30 minutes, for example) from the start of the first error mode (ERROR 1), the controller 800 causes the ice maker to exit the first error mode (ERROR 1) and resume normal operations (e.g., initialization, freeze, check bail arm, harvest, etc.).

If the ejector finger is not at the "Home" position (i.e., the Hall sensor 710 is not LOW, but is HIGH) (path "No" in FIG. 17A), the motor rotates in the second direction or in the counter-clockwise (CCW) direction until the ejector finger is at the "Home" position (i.e., the Hall sensor 710 is LOW) or for a second predetermined number of steps, whichever occurs first. The second predetermined number of steps may be programmed in the memory of the controller 800 as a sufficient number of rotational steps of the motor that would allow the ejector finger 550 to enter the "Home" position at some point during rotation of the motor assuming a starting position of the ejector finger is outside the "Home" position, for example 332 degrees (when the "Home" position has a range of 28 degrees). If the Hall sensor 710 is LOW without timeout, the controller 800 causes the ice maker to enter an ice maker initialization mode.

During the first error mode (ERROR 1), the controller 800 checks whether the first predetermined time (e.g., 30 minutes, for example) from the start of the first error mode (ERROR 1) has elapsed. If the first predetermined time (30 minutes, for example) from the start of the first error mode (ERROR 1) has elapsed and the Hall sensor has not shown expected operation, the controller 800 causes the ice maker to enter a second error mode (ERROR 2) that is different from the first error mode (ERROR 1). In other words, if the status of the Hall sensor 710 does not change (which indicates that the ejector finger 550 cannot rotate either in the counter-clockwise (CCW) direction or in the clockwise (CW) direction during the rotation of the motor) after operating in the first error mode (ERROR 1) for the first predetermined time (e.g., 30 minutes), the controller 800 causes the ice maker to enter a second error mode (ERROR 2) that is different from the first error mode (ERROR 1).

Figure 17B:
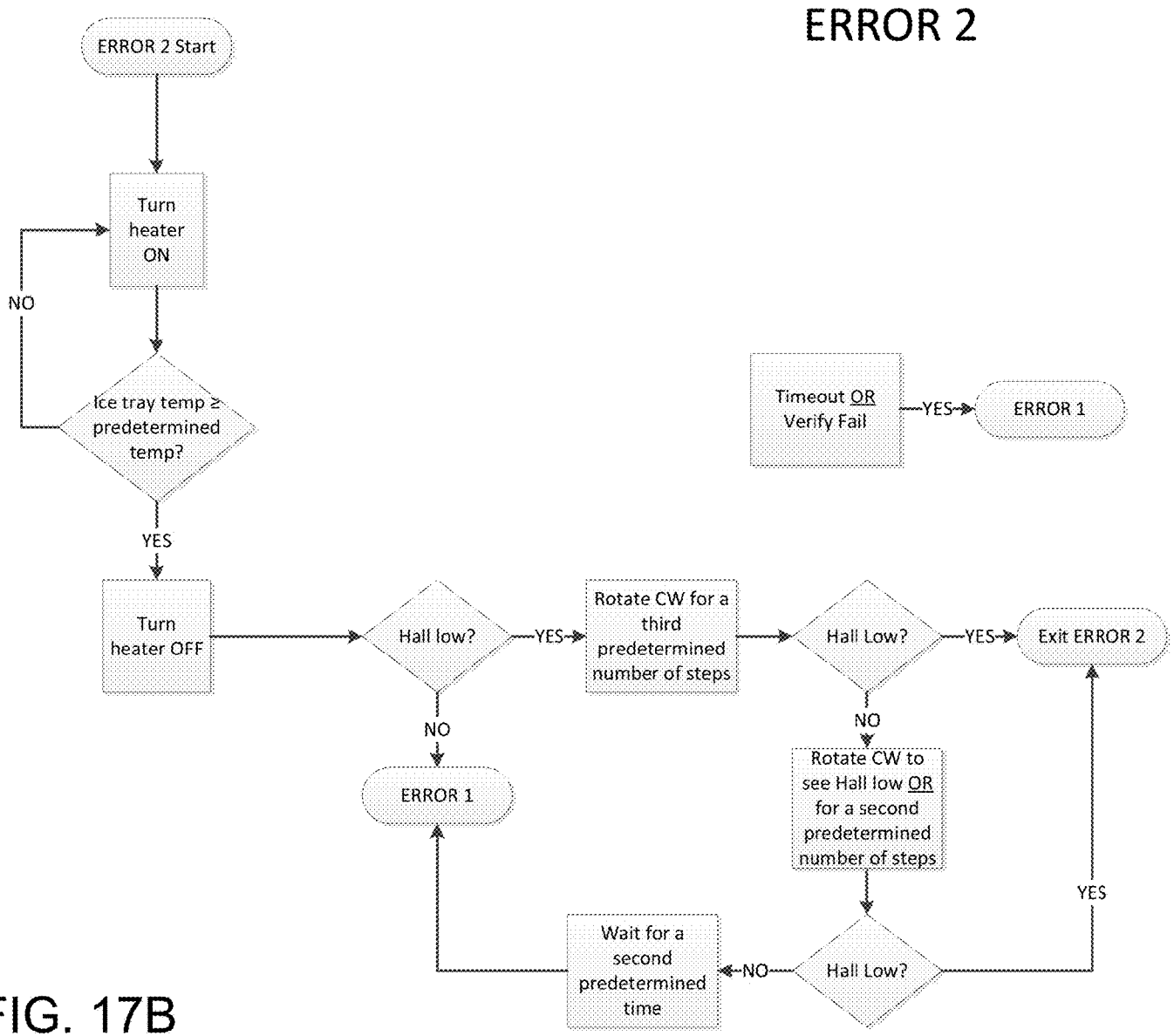
FIG. 17B is a flowchart illustrating the ice maker's second error mode.

FIG. 17B illustrates the second error mode (ERROR 2) of the ice maker. The second error mode starts if the first error mode (ERROR 1) cannot recover the ice maker for 30 minutes. During the second error mode, the controller 800 turns on the ice maker heater 126. The controller 800 turns off the ice maker heater 126 when the ice tray temperature is equal to or greater than a second predetermined temperature (e.g., 2° C. or 5° C., for example). The controller 800 then checks whether the ejector finger 550 is at the "Home" position (i.e., the Hall sensor 710 is LOW).

If the ejector finger is not at the "Home" position (i.e., the Hall sensor 710 is not LOW, but is HIGH) (path "No" in FIG. 17B), the controller 800 terminates the second error mode (ERROR 2) and causes the ice maker to enter the first error mode (ERROR 1).

If the ejector finger 550 is at the "Home" position (i.e., the Hall sensor 710 is LOW) (path "Yes" in FIG. 17B), the motor rotates in the first direction or in the clockwise (CW) direction for a third predetermined number of steps. The third predetermined number of steps may be programmed in the memory of the controller 800 as a sufficient number of rotational steps of the motor that would allow the ejector finger 550 to leave the "Home" position and drive the bail arm to check the ice level assuming a starting position of the ejector finger is inside the "Home" position, for example 53 degrees (when the "Home" position and "Full Bucket" position are within 53 degrees of each other). Then, the controller 800 checks again whether the ejector finger 550 is at the "Home" position (i.e., the Hall sensor 710 is LOW).

If the ejector finger is at the "Home" position (i.e., the Hall sensor 710 is LOW) (second path "Yes" to the right in FIG. 17B), the controller 800 terminates the second error mode (ERROR 2) and causes the ice maker to enter an ice maker initialization mode. If during the ice maker initialization mode, the status of the Hall sensor 710 does not change (which indicates that the ejector finger 550 cannot rotate either in the counter-clockwise (CCW) direction or in the clockwise (CW) direction during the rotation of the motor), the controller 800 terminates the ice maker initialization mode and causes the ice maker to enter the first error mode (ERROR 1).

If the ejector finger 550 is not at the "Home" position (i.e., the Hall sensor 710 is not LOW, but is HIGH) (second path "No" to the right in FIG. 17B), the motor rotates in the first direction or in the clockwise (CW) direction until the ejector finger 550 is at the "Home" position (i.e., the Hall sensor 710 is LOW) and the controller 800 terminates the second error mode (ERROR 2), or if the ejector finger 550 is not at the "Home" position after rotating the motor for the second predetermined number of steps, the controller 800 waits for a second predetermined time (e.g., 4 hours, for example) and after the second predetermined time elapses, causes the ice maker to enter the first error mode (ERROR 1).

Figure 18:
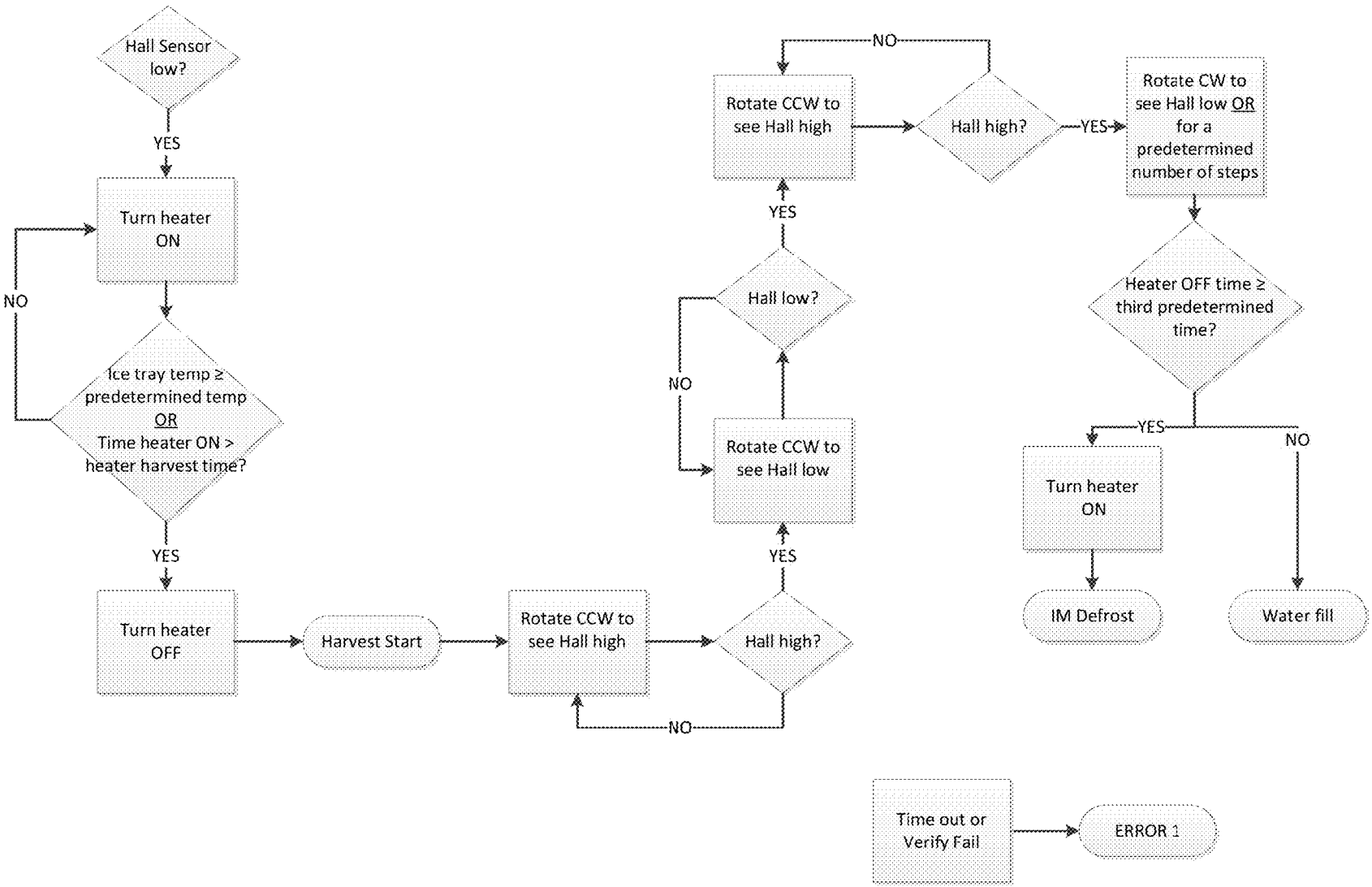
FIG. 18 is a flowchart illustrating the ice maker's harvest process.

As illustrated in FIG. 18, in the ice maker harvest mode, the motor can rotate the ejector finger 550 so that the ejector finger 550 leaves the "Home" position, rotates one revolution, and then returns to the "Home" position. The controller 800 checks whether the ejector finger 550 is at the "Home" position (i.e., the Hall sensor 710 is LOW) and whether the bail arm 610 is in the ice harvest position.

If the ejector finger 550 is at the "Home" position (path "Yes" in FIG. 18), the controller 800 turns ON the ice maker heater 126. The controller 800 turns off the ice maker heater 126 when an ice maker heater harvest time has elapsed or when the ice tray temperature is equal to or greater than a first predetermined temperature (e.g., −1° C., for example). The ice maker heater harvest time may be a predetermined period of time that would allow congealed ice pieces to separate from the ice mold 102 during the ice harvesting operation. The controller 800 then causes the ice maker to enter a harvest mode and perform a harvest operation.

The harvest operation includes rotating the motor in the second direction or in the counter-clockwise (CCW) direction to leave the "Home" position or until the ejector finger 550 is not at the "Home" position (i.e., the Hall sensor 710 is HIGH), rotating the motor in the second direction or in the counter-clockwise (CCW) direction until the ejector finger 550 is at the "Home" position (i.e., the Hall sensor 710 is LOW), and then again rotating the motor in the second direction or in the counter-clockwise (CCW) direction until the ejector finger 550 is not at the "Home" position (i.e., the Hall sensor 710 is HIGH).

When the harvest operation is completed before the motor has rotated a corresponding number of steps, the motor rotates in the first direction or in the clockwise (CW) direction until the ejector finger 550 is at the "Home" position. When any part of the harvest operation is not completed before the motor has rotated the corresponding number of steps, the controller 800 causes the ice maker to enter the first error mode (ERROR 1).

The controller 800 then determines either a time during which the ice maker heater has been deactivated (e.g., by checking an ice maker defrost timer) or a time during which the icemaker has been making ice (the time the ice maker has been in freeze mode—Freeze ON time). The controller 800 compares either the time that the ice maker heater has been deactivated or the time during which the icemaker has been making ice to a third predetermined time. If either the time that the ice maker heater has been deactivated or the time during which the icemaker has been making ice is equal to or greater than the third predetermined time, the controller 800 turns on the ice maker heater and causes the ice maker to enter an ice maker defrost mode. The third predetermined time can be one fixed time period (e.g., 12 hours or any other time period in a particular cycle). For example, when the ice maker heater has been deactivated for a continuous period of 12 hours, for example, the controller 800 can cause the ice maker to enter an ice maker defrost mode after the next harvest mode, but before the "Water Fill" mode. Similarly, when the ice maker has been in a freeze mode (e.g., making ice) for a continuous period of 12 hours, for example, the controller 800 can cause the ice maker to enter an ice maker defrost mode after the next harvest mode, but before the "Water Fill" mode. Alternatively, the third predetermined time can be a combination of time periods of different events in a particular cycle. For example, when the ice maker has been in a freeze mode (e.g., making ice) for a continuous period of 10 hours, for example, the controller 800 can cause the ice maker to enter a "Full Bucket" mode (the ice bin is full of ice). When the ice maker has been in a "Full Bucket" mode for a continuous period of 5 hours, for example, the controller 800 can cause the ice maker to enter the freeze mode, once again. When the ice maker has been in the freeze mode for an additional continuous period of 2 hours, for example, (so that the ice maker has been in the freeze mode for a cumulative period of 12 hours, the controller 800 can cause the ice maker to enter an ice maker defrost mode after the next harvest mode, but before the "Water Fill" mode.

If the time that the ice maker heater has been deactivated is lower than the predetermined time, the controller 800 causes the ice maker to enter a "Water Fill" mode and fill the ice tray with water.

Figure 19:
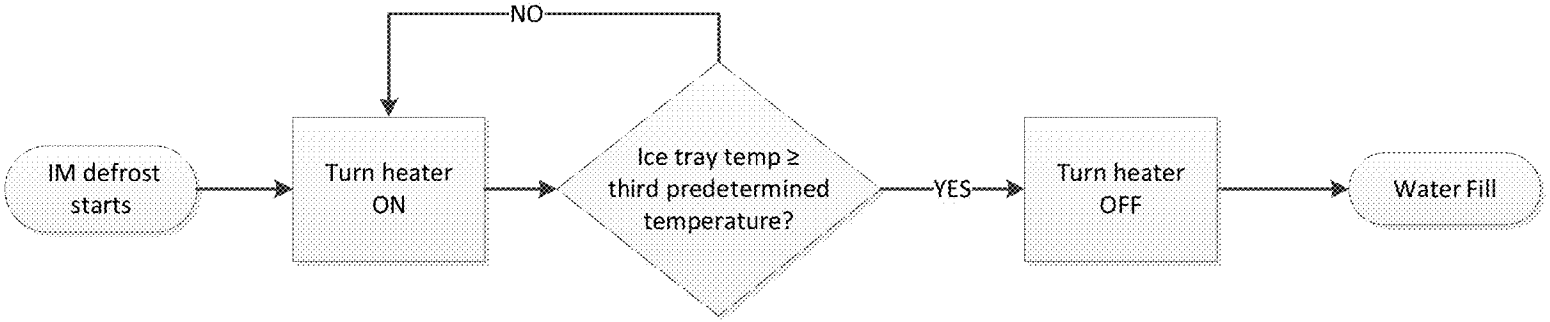
FIG. 19 is a flowchart illustrating the ice maker's defrost process.

As illustrated in FIG. 18, the ice maker defrost mode starts after the harvest mode and when an ice maker defrost timer reaches the third predetermined time. During the ice maker defrost mode (FIG. 19), the controller 800 activates only the ice maker heater 126 to melt frost built up on the ice tray. The controller 800 turns off the ice maker heater 126 when the temperature of the ice tray reaches a predetermined defrost temperature (e.g., 1.7° C.) (also referred to as a "third predetermined temperature"). The ice maker defrost mode runs independently from the defrosting of the ice maker evaporator or the entire refrigeration system defrost.

The invention has been described with reference to the example embodiments described above. Modifications and alterations will occur to others upon a reading and understanding of this specification. Example embodiments incorporating one or more aspects of the invention are intended to include all such modifications and alterations insofar as they come within the scope of the appended claims and their equivalents.

What is claimed is:

1. A method for controlling an ice maker having an ice maker heater and a motor configured to rotate an ejector finger relative to an ice tray in a first direction and in a second direction opposite the first direction to discharge ice from the ice tray, the method comprising:

determining whether an error condition has occurred; and when it is determined that the error condition has occurred, entering a first error mode comprising:

turning on the ice maker heater;

turning off the ice maker heater when an ice maker heater error correction time has elapsed or when a temperature of the ice tray is equal to or greater than a first predetermined temperature;

determining whether the ejector finger is at a home position;

when the ejector finger is at the home position, stepwise rotating the motor in the second direction until a first occurrence of at least one of the ejector finger not being at the home position or a first predetermined number of rotating steps being made, and then rotating the motor in the first direction until the ejector finger is at the home position; and when the ejector finger is not at the home position, stepwise rotating the motor in the second direction until a first occurrence of at least one of the ejector finger being at the home position or a second predetermined number of rotating steps being made, wherein the determining whether the error condition has occurred includes determining the error condition has occurred when the ejector finger is not at the home position at some time during the rotating the motor; and exiting the first error mode when, after rotating the motor in the first direction or in the second direction, the ejector finger is at the home position within a first predetermined time:

wherein if the first error mode is not exited after the first predetermined time, entering a second error mode different from the first error mode, wherein the second error mode includes:

turning on the ice maker heater;

turning off the ice maker heater when the temperature of the ice tray is equal to or greater than a second predetermined temperature;

determining whether the ejector finger is at the home position;

when the ejector finger is not at the home position, terminating the second error mode and entering the first error mode;

when the ejector finger is at the home position, rotating the motor in the first direction for a third predetermined number of rotating steps;

determining whether the ejector finger is at the home position;

when the ejector finger is at the home position, terminating the second error mode; and when the ejector finger is not at the home position, rotating the motor in the first direction until the ejector finger is at the home position and terminating the second error mode or, if the ejector finger is not at the home position after rotating the motor for the second predetermined number of rotating steps, waiting for a second predetermined time and after the second predetermined time elapses, entering the first error mode.

2. The method for controlling the ice maker of claim 1, wherein the determining whether the error condition has occurred includes determining the error condition has occurred when the ejector finger cannot rotate in one of the first direction or in the second direction.

3. The method for controlling the ice maker of claim 2, wherein the determining whether the ejector finger is at the home position is performed by a sensor configured to detect an angular position of the ejector finger.

4. The method for controlling the ice maker of claim 1, wherein the determining whether the error condition has occurred includes determining the error condition has occurred when the ejector finger rotates in the second direction the first predetermined number of rotating steps and the ejector finger is not at the home position.

5. The method for controlling the ice maker of claim 1, wherein the determining whether the error condition has occurred includes determining the error condition has occurred when the ejector finger rotates in the second direction the second predetermined number of rotating steps and the ejector finger is not at the home position.

6. The method for controlling the ice maker of claim 1, wherein at least one of the first predetermined number of rotating steps or the second predetermined number of rotating steps correspond to an amount of rotation of the motor relative to degrees of rotation.

7. A method for controlling an ice maker having an ice maker heater and a motor configured to rotate an ejector finger relative to an ice tray in a first direction and in a second direction opposite the first direction to discharge ice from the ice tray, the method comprising determining whether an error condition has occurred; and when it is determined that the error condition has occurred, entering a first error mode comprising:

turning on the ice maker heater;

turning off the ice maker heater when an ice maker heater error correction time has elapsed or when a temperature of the ice tray is equal to or greater than a first predetermined temperature;

determining whether the ejector finger is at a home position;

when the ejector finger is at the home position, stepwise rotating the motor in the second direction until a first occurrence of at least one of the ejector finger not being at the home position or a first predetermined number of rotating steps being made, and then rotating the motor in the first direction until the ejector finger is at the home position;

when the ejector finger is not at the home position, stepwise rotating the motor in the second direction until a first occurrence of at least one of the ejector finger being at the home position or a second predetermined number of rotating steps being made, wherein the determining whether the error condition has occurred includes determining the error condition has occurred when the ejector finger is not at the home position at some time during the rotating the motor;

counting at least one of an ice maker heater deactivation period of time or a time the icemaker has been making ice;

comparing at least one of the ice maker heater deactivation period of time or the time the icemaker has been making ice to a third predetermined time;

when at least one of the ice maker heater deactivation period of time or the time the icemaker has been making ice is equal to or greater than the third predetermined time and when an ice bin is not full of ice, turning on the ice maker heater to melt frost built up on the ice tray;

monitoring the temperature of the ice tray;

comparing the temperature of the ice tray to a third predetermined temperature;

turning off the ice maker heater when the temperature of the ice tray is equal to or greater than the third predetermined temperature;

exiting the first error mode when, after rotating the motor in the first direction or in the second direction, the ejector finger is at the home position within a first predetermined time; and entering a second error mode different from the first error mode if the first error mode is not exited after the first predetermined time.

8. The method for controlling the ice maker of claim 7, further comprising:

after turning off the ice maker heater, filling the ice maker with water.

9. The method for controlling the ice maker of claim 7, wherein at least one of the first predetermined number of rotating steps or the second predetermined number of rotating steps correspond to an amount of rotation of the motor relative to degrees of rotation.

* * * * *